US006787297B1

(12) United States Patent
Link et al.

(10) Patent No.: US 6,787,297 B1
(45) Date of Patent: Sep. 7, 2004

(54) DYE-LAYERED SILVER HALIDE PHOTOGRAPHIC ELEMENTS WITH LOW DYE STAIN

(75) Inventors: Steven G. Link, Rochester, NY (US); Richard L. Parton, Webster, NY (US); Robert D. Wilson, Rochester, NY (US); Roger A. Bryant, Rochester, NY (US); William J. Harrison, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/436,288

(22) Filed: May 12, 2003

(51) Int. Cl.[7] ..... G03C 1/005; G03C 1/494

(52) U.S. Cl. ..... 430/572; 430/570; 430/574; 430/576; 430/581; 430/585; 430/588; 430/584; 430/591

(58) Field of Search ..... 430/509, 570, 430/572, 574, 576, 581, 585, 584, 591

(56) References Cited

U.S. PATENT DOCUMENTS

| | | | |
|---|---|---|---|
| 3,622,316 A | 11/1971 | Bird et al. | |
| 6,048,681 A | 4/2000 | Suzumoto et al. | |
| 6,117,629 A | 9/2000 | Yamashita et al. | |
| 6,143,486 A | 11/2000 | Parton et al. | |
| 6,165,703 A | 12/2000 | Parton et al. | |
| 6,312,883 B1 | 11/2001 | Parton et al. | |
| 6,329,133 B1 | 12/2001 | Andrievsky et al. | |
| 6,331,385 B1 | 12/2001 | Deaton et al. | |
| 6,361,932 B1 | 3/2002 | Parton et al. | |
| 6,558,893 B1 * | 5/2003 | Parton et al. | 430/574 |
| 6,620,581 B1 * | 9/2003 | Parton et al. | 430/570 |

FOREIGN PATENT DOCUMENTS

| | | |
|---|---|---|
| EP | 1 061 411 A1 | 12/2000 |
| EP | 0 838 719 B1 | 2/2003 |
| JP | 10/171058 | 6/1998 |

OTHER PUBLICATIONS

Thomas L. Penner et al, *Photographic Science and Engineering,* "Spectral Shifts and Physical Layering of Sensitizing Dye Combinations in Silver Halide Emulsions", vol. 20, 1976, pp. 97–106.

Thomas L. Penner, *Photographic Science and Engineering,* "Electrophoresis of Spectral Sensitizing Dyes on Silver Halide: Evidence for Dye Layering", vol. 21, 1977, pp. 32–36.

IP.com publication 000006637D published Jan. 17, 2002, pp. 1–51.

U.S. application Ser. No. 10/347,014 filed Jan. 17, 2003 "Silver Halide Material Comprising Low Stain Antenna Dyes" of Richard L. Parton et al.

* cited by examiner

*Primary Examiner*—Geraldine Letscher
(74) *Attorney, Agent, or Firm*—Sarah Meeks Roberts

(57) ABSTRACT

This invention provides a silver halide photographic element comprising at least one silver halide emulsion comprising silver halide grains which have associated therewith at least an inner dye layer and an outer dye layer wherein the outer dye layer comprises a dye having at least one substituent that has a positive charge, said photographic element further comprising a cyanine dye of formula (I) or (II) (as described in the specification) that is capable of spectrally sensitizing a silver halide emulsion.

20 Claims, No Drawings

DYE-LAYERED SILVER HALIDE PHOTOGRAPHIC ELEMENTS WITH LOW DYE STAIN

FIELD OF THE INVENTION

This invention relates to a silver halide photographic element with enhanced light absorption and low dye stain. It more specifically relates to a silver halide photographic element containing a dye layered emulsion and a specific class of sensitizing dyes.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to the increased surface area per mole of silver. However, in most photographic systems, it is still the case that not all of the available light is being collected.

The need is especially great in the blue spectral region where a combination of low source intensity and relatively low dye extinction results in a deficient photo response. The need for increased light absorption is also great in the green sensitization of the magenta record of multilayer color film photographic elements. The eye is most sensitive to the magenta image dye, and this layer has the largest impact on color reproduction. Higher speed in this layer can be used to obtain improved color and image quality characteristics. The cyan layer could also benefit from increased red-light absorption that could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.*, 18, 562 (1974)). One method is to synthesize molecules in which two dye chromophores are covalently connected by a linking group (see U.S. Pat. Nos. 2,518,731; 3,976,493; 3,976,640; and 3,622,316; Kokal Sho 64(1989)91134, and EP 565 074). This approach suffers from the fact that when the two dyes are connected, they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion; however, they tended to sensitize poorly, and dye stain (an unwanted increase in D-min due to retained sensitizing dye after processing) was severe in this system and unacceptable.

A different strategy involves the use of two dyes that are not covalently linked to one another. In this approach the dyes can be added sequentially and are less likely to interfere with each other. Miyasaka et al. in EP 270 079 and EP 270 082 describe silver halide photographic material having an emulsion spectrally sensitized with an adsorbable sensitizing dye used in combination with a non-adsorbable luminescent dye that is located in the gelatin phase of the element. Steiger et al. in U.S. Pat. Nos. 4,040,825 and 4,138,551 describe a silver halide photographic material having an emulsion spectrally sensitized with an adsorbable sensitizing dye used in combination with a second dye that is bonded to gelatin. The problem with these approaches is that unless the dye that is not adsorbed to the grain is in close proximity to the dye adsorbed on the grain (less than 50 angstroms separation), efficient energy transfer will not occur (see T. Förster, *Disc. Faraday Soc.*, 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.*, 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.*, 20, 97 (1976); see also Penner, *Photogr. Sci. Eng.*, 21, 32 (1977). In these cases, the outer dye layer absorbed light at a longer wavelength than the inner dye layer (the layer adsorbed to the silver halide grain). Bird et al. in U.S. Pat. No. 3,622,316 describes a similar system. A requirement was that the outer dye layer absorb light at a shorter wavelength than the inner layer. A problem with previous dye layering approaches was that the dye layers described produced a very broad sensitization envelope. This may be desirable for some black-and-white photographic applications, but in a multilayer color film element this would lead to poor color reproduction since, for example, the silver halide grains in the same color record would be sensitive to both green and red light.

Yamashita et al. (EP 838 719 A2, U.S. Pat. No. 6,117,629) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et al. teaches that dye layering will not occur if this requirement is not met. This is undesirable because such substitutents can lead to large amounts of retained dye after processing (dye stain) that affords increased D-min. Similar results are described in U.S. Pat. No. 6,048,681. EP 1 061 411 A1 describes forming dye layers by using dyes with additional polycyclic rings. The dyes have at least one heterocyclic ring that has two or more additional rings attached to it. This may promote dye-dye interactions by increasing van der Waals forces; however, adding hydrophobic, aromatic rings to the dye molecules is undesirable in that the dyes are more likely to be retained after processing and give higher dye stain. Yamashita and Kobayashi (JP 10/171058) describe silver halide photographic emulsions that contain an anionic dye and a cationic dye, where the charge of either the anionic dye or the cationic dye is two or greater.

Further improvements in dye layering have been described in U.S. Pat. Nos. 6,143,486; 6,165,703; 6,329,133; 6,331,385; and 6,361,932. Useful antenna dyes for dye layering that have less dye stain after processing were described in U.S. Pat. No. 6,312,883.

However, even with the improvements in dye layering technology to date, it is still difficult to use emulsions with more than one layer of dye in a multilayer color film element that generally carries a higher coated level of silver halide. The reason is that the level of stain from the excess dye from the second layer is often unacceptable and contributes to the minimum density. This is particularly true for the green and red density of color negative and color reversal films. In color reversal films, the retained dye is visually noticeable and objectionable. In color negative films, higher levels of green and red density have a negative impact on printing because a higher density in the negative requires a longer or more intense exposure when printing the negative. This is a particular problem for the green density of color negative films. Red sensitive emulsions in color negative films are commonly dyed with J-aggregating cyanine dyes, but when these dyes are retained in the film, they are present in the monomeric state where they absorb green light. Thus, retained red dyes add to green density that is already high from the presence of magenta colored cyan image couplers and the presence of retained green sensitizing dyes. Dyes that are useful for forming a second layer on red sensitive emulsions, i.e., they absorb red light, will also contribute to additional green minimum density after processing, raising the green density to unacceptable levels.

A particular problem with retained green sensitizing dye is the impact of the dye absorption on automatic printers. An automatic printer measures the green density through a narrow filter that has a peak transmission at 525 nm or longer wavelength. The printer measures the minimum blue, green, and red density through separate filters and sets the appropriate exposure for the negative based on the measured values. A green sensitizing dye or antenna dye that is retained in its monomeric state will have a peak absorption in the film around 500 to 510 nm. The filter in the printer will not measure the density contribution of the retained dye correctly because the filter is measuring transmitted light at a longer wavelength. It will set the printer for a green exposure on the paper that is too low. However, the green sensitivity of the paper between 500 and 510 nm is substantial, and the added density of the retained monomeric green dye in the negative will cause the paper to be underexposed with green light. This means that a film incorporating a green antenna dye that results in a higher absorption of light around 500 to 510 nm will not print compatibly with a similar film that does not contain a green antenna dye. This is known in the trade as poor printer compatibility and leads to lower quality prints or added time and expense for the photofinisher. It is undesirable and must be remedied for the practical use of antenna dyes in multilayer consumer color negative films.

PROBLEM TO BE SOLVED BY THE INVENTION

The use of more than one dye layer on silver halide emulsions to enhance light absorption in a multilayer photographic element is often accompanied by unacceptably high levels of post-process retained dye (dye stain). This dye stain can lead to poor printer compatibility that produces lower quality prints and added cost to the photofinisher. It would be highly desirable if combinations of dyes could be found that allow the use of more than one layer of dye on the emulsion surface without a large, unacceptable increase in dye stain.

SUMMARY OF THE INVENTION

This invention provides a silver halide photographic element comprising at least one silver halide emulsion comprising silver halide grains which have associated therewith at least an inner dye layer and an outer dye layer wherein the outer dye layer comprises a dye having at least one substituent that has a positive charge, said photographic element further comprising a cyanine dye of formula I or II that is capable of spectrally sensitizing a silver halide emulsion:

(I)

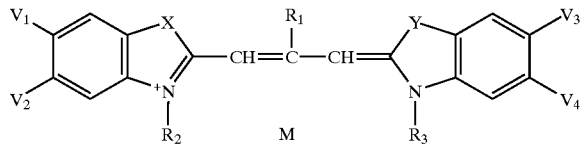

wherein:

X is O or $NR_4$;

Y is O, S, or $NR_4$;

$R_1$ is H or a 1–4 carbon alkyl group;

$R_2$ and $R_3$ are independently a 1–6 carbon alkyl group comprising an acid salt substituent;

$R_4$ is a 1–4 carbon alkyl group;

$V_1$ to $V_4$ are hydrogen or substituents with a pi constant of less than 1.0;

M is a counterion to balance the charge if necessary;

(II)

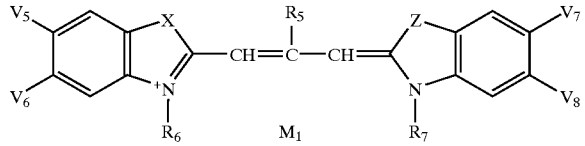

wherein:

W is O, S, Se, or $NR_4$;

Z is S or Se;

$R_5$ is H or a 1–4 carbon alkyl group;

$R_6$ and $R_7$ are independently 1–6 carbon alkyl groups comprising an acid salt substituent;

$R_4$ is a 1–4 carbon alkyl group;

$V_5$ to $V_8$ are hydrogen or substituents with a pi constant of less than 0.75 provided that at least three of $V_5$ to $V_8$ are hydrogen or substituents with a pi constant of 0.65 or less;

$M_1$ is a counterion to balance the charge if necessary.

This invention provides a photographic element having the advantages of dye layered emulsions without a large, unacceptable increase in dye stain.

DETAILED DESCRIPTION OF THE INVENTION

The color silver halide photographic element useful in the present invention comprises a support bearing at least one silver halide emulsion. In one preferred embodiment the present invention comprises a support bearing a cyan dye image-forning unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. It is preferred that the color silver halide elements are negative working silver halide elements. It is also preferred that the silver halide photographic elements are capture or origination elements such as a color negative film or a motion picture origination film.

The photographic elements of the invention comprise a silver halide emulsion comprising silver halide grains having associated therewith at least two dye layers, i.e., an inner dye layer and an outer dye layer, wherein the outer dye layer comprises a dye having at least one substituent that has a positive charge. Preferably the dye layers comprise (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation-π interactions, or by in situ bond formation. The inner dye layer(s) is adsorbed to the silver halide grains and contains at least one spectral sensitizer. The outer dye layer(s) (also referred to as an antenna dye) absorbs light at an equal or higher energy (equal or shorter wavelength) than the adjacent inner dye layer(s). The light energy emission wavelength of the outer dye layer overlaps with the light energy absorption wavelength of the adjacent inner dye layer. Preferably the dye image forming unit containing the dye layered silver halide emulsion is the magenta or cyan dye image forming unit.

Dye 1 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferably, Dye 1 is a cyanine dye. There may be more than one dye in the inner layer. Dye 1 may be used in combination with a second or third dye that may also be a member of one of the classes listed above.

In one preferred embodiment Dye 1 comprises at least one anionic substiutent. Examples of anionic substituents are alkyl groups containing acid salts. Acid salt are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to, 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, and methanesulfonylcarbamoylmethyl.

Dye 2 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferably, Dye 2 is not a cyanine dye. Most preferably, Dye 2 is a merocyanine dye. A merocyanine dye has one basic nucleus and one acidic nucleus separated by a conjugated chain having an even number of methine carbons (see *The Theory of the Photographic Process*, $4^{th}$ edition, T. H. James, editor, Macmillan Publishing Co., New York, 1977 for an explanation of basic and acidic nuclei).

Dye 2 has at least one cationic substitutent. The term "cationic substituent" includes a substituent which can be protonated to become a cationic substituent. Examples of positively charged substituents are 3-(trimethylammonio) propyl), 3-(4-ammoniobutyl), and 3-(4-guanidinobutyl). Other examples are any substitutents that take on a positive charge in the silver halide emulsion melt, for example, by protonation such as aminoalkyl substitutents, e.g., 3-(3-aminopropyl), 3-(3-dimethylaminopropyl), and 4-(4-methylaminopropyl). In a preferred embodiment of the invention Dye 1 comprises at least one anionic substiutent, and Dye 2 comprises at least one cationic substitutent.

Specific spectral.sensitizing dyes (Dye 1) and antenna dyes (Dye 2) useful in the invention and methods of dye layering are described in detail in Parton et al European publications EP 0 985 967 corresponding to U.S. Pat. No. 6,361,932, and EP 1 199 595 corresponding to U.S. application Ser. No. 09/690,068 filed Oct. 16, 2000, U.S. Pat. Nos. 6,143,486; 6,165,703; and 6,312,883; Deaton et al. U.S. Pat. No. 6,331,385; and Andrievsky et al. U.S. Pat. No. 6,329,133, the entire contents of which are herein incorporated by reference. The dyes of the commonly-assigned and co-filed U.S. patent application of Parton, et al., SILVER HALIDE MATERIAL COMPRISING LOW STAIN ANTENNA DYES, is also incorporated herein by reference. Dye 1 and Dye 2 are also described in detail in "Technology Useful in Combination With Antenna Dyes" IP.com Publication 000006637D, (IPCOM000006637D), published Jan. 17, 2002, pp. 1–51. Also discussed in the above references are methods to determine if dye layering has occurred, said discussion also incorporated by reference.

In a preferred embodiment of the invention the silver halide grains are sensitized with at least one dye having a net charge of −1 and at least one dye having a net charge of +1. In a more preferred embodiment, the silver halide grains are sensitized with at least one dye having a net charge of −1 and at least one dye having a net charge of +1 and neither dye has an aromatic or heteroaromatic substitute attached to the chromophore via the nitrogen atoms of the dye. In another preferred embodiment the silver halide grains are sensitized with at least one dye containing at least one anionic substituent and at least one dye containing at least one cationic substituent. In a more preferred embodiment, the silver halide grains are sensitized with at least one dye containing at least one anionic substituent such that the net charge of the dye is −1 and at least one dye containing at least one cationic substituent such that the net charge of the dye is +1.

In one embodiment of the invention a dye of structure (I) or (II) (described hereafter) is actually contained in the inner layer (i.e., may act as Dye 1) of the dye layered emulsion. Preferably in this embodiment the dye layered silver halide emulsion is a green sensitive silver halide emulsion, and the inner dye layer comprises at least one dye represented by structure (I) or the dye layered silver halide emulsion is a red sensitive silver halide emulsion and the inner dye layer comprises at least one dye represented by structure (II).

Preferably in this embodiment of the invention, the silver halide emulsion is dyed with a saturation or near saturation monolayer of one or more cyanine dyes, at least one of which is of structures (I) or (II). The area a dye covers on the silver halide surface can be determined by preparing a dye concentration series and choosing the dye level for optimum performance or by well-known techniques such as dye adsorption isotherms (for example, see W. West, B. H. Carroll, and D. H. Whitcomb, J. Phys. Chem, 56, 1054 (1962)). The second layer consists of antenna dyes that have a net positive charge. More. preferably the antenna dyes are merocyanine dyes having at least one substituent that has a positive charge. In a more preferred embodiment the dye of structures (I) or (II) is present at a concentration of at least 80% of monolayer coverage, and the antenna dye or dyes are present in an amount of at least 50% of monolayer coverage. In one preferred embodiment, both the dye of structure (I) and any other dyes in the inner layer, as well as the antenna dyes of the outer dye layer, have their maximum light absorption between 500 to 600 nm. In another preferred embodiment, both the dye of structure (II) and other dyes in the inner layer, as well as the antenna dyes of the outer dye layer, have their maximum light absorption between 600 to 700 nm.

In another embodiment the dye layered silver halide emulsion is a separate emulsion from the emulsion containing a dye of structures (I) or (II). In this embodiment the silver halide emulsion containing the dye of structures (I) or (II) may be in a separate layer in the same dye image forming unit, or it may be in a different dye image forming unit. It might also be blended in the same emulsion layer. Preferably in this embodiment the dye layered silver halide emulsion is a green sensitive silver halide emulsion, and the photographic element further comprises one or more additional green sensitive silver halide emulsions, at least one of which is sensitized with at least one dye described by structure (I); or the dye layered silver halide emulsion is a red sensitive silver halide emulsion and the said photographic element further comprises one or more additional red sensitive silver halide emulsions, at least one of which is sensitized with at least one dye described by structure (II). Preferably at least 30%, and more preferably at least 50%, of the surface area of the one or more additional green or red sensitive emulsions are sensitized with at least one dye described by structure (I) or structure (II) respectively.

More specifically, in one aspect of this embodiment the element may comprise two to eight emulsions, all sensitive to green light, contained in one or more sublayers, where at least 30% by surface area of the emulsions that do not contain an antenna dye are sensitized with at least one dye of structure (I). More preferably at least 50% by surface area of the emulsions that do not contain an antenna dye are sensitized with at least one dye of structure (I). Multiple emulsions of various grain sizes are used to shape the tone scale of the photographic element and extend the latitude of exposures where good image quality can be obtained. When an emulsion with a second layer of dye is used in a multilayer silver halide photographic element, the additional density from retained dye in the film may become unacceptable. The use of dyes of structure (I) on the emulsions that do not contain antenna sensitization reduces the density from retained dye to an acceptable level. It is preferred that the smallest emulsions in the set of emulsions be sensitized with dye of structure (I), since smaller emulsions have more surface area per mole of silver and carry more sensitizing dye at a given percentage of monolayer coverage. In this embodiment of the invention, it is preferred that at least 30% and more preferably 50 mole % of the total sensitizing dyes on all the green sensitive emulsions are selected from dyes of structure (I). It is more preferred that 70 mole % of the total dye be dyes of structure (I). The mole % of a dye in a photographic multilayer film element can be calculated from the moles of dye per mole of silver on the emulsion and adjusting for the coated weight of each emulsion in the film element.

In another aspect of this embodiment the element comprises two to eight emulsions, all sensitive to red light, contained in one or more sublayers, where at least 30% by surface area and more preferably at least 50% by surface area of the emulsions that do not contain an antenna dye are sensitized with at least one dye of structure (II). As noted above, when an emulsion with a second layer of dye is used in a multilayer silver halide photographic element, the additional density from retained dye in the film may become unacceptable. Emulsions that are sensitive to red light are usually sensitized with J-aggregating dyes. When these dyes are de-aggregated and retained in the film, they absorb green light, contributing unwanted green density. The use of dyes of structure (II) on the emulsions that do not contain antenna sensitization reduces the green density from retained dye to an acceptable level. Again, it is preferred that the smallest emulsions in the set of emulsions be sensitized with a dye of structure (II), since smaller emulsions have more surface area per mole of silver and carry more sensitizing dye at a given percentage of monolayer coverage. In this embodiment of the invention, it is preferred that at least 50 mole % of the total sensitizing dyes on all the red sensitive emulsions are selected from dyes of structure (II). It is more preferred that 70 mole % of the total dye be dyes of structure (II).

The dyes of structure (I) are as follows.

(I)

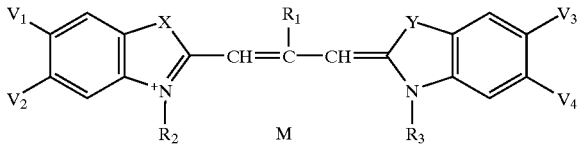

X is O or $NR_4$; making the ring a benzoxazole or benzimidazole ring, with the benzoxazole ring beings preferred. Y is O, S, or $NR_4$, making the second ring a benzoxazole, benzothiazole, or benzimidazole. $R_1$ is hydrogen or a 1–4 carbon alkyl group, for example, methyl, ethyl, or propyl. Ethyl is preferred. The alkyl group may be a chain or branched group. $R_2$ and $R_3$ are independently 1–6 carbon alkyl groups comprising an acid salt substituent. $R_2$ and $R_3$ may be further substituted. Examples of acid salt substituents are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to, 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, and methanesulfonylcarbamoylmethyl. $R_4$ is a 1–4 carbon alkyl group;

$V_1$ to $V_4$ are hydrogen or substituents with a pi constant of less than 1.0 where pi is the hydrophobicity constant. More preferably V1 to V4 represent hydrogen or substituents with a pi constant between and including 0.9 and −2.0. Most preferably the pi constant should be between 0.85 and −2.0. M represents a counterion to balance the charge of the acid salt substituents. M may be an inorganic or organic cation, but is preferably a monovalent metal cation or an ammonium ion, for example, lithium, sodium, or potassium ions, triethylammonium, tetrabutylammonium, and tetramethylguanidinium.

In one preferred embodiment, the dye of formula (I) can be represented by formula (Ib)

(Ib)

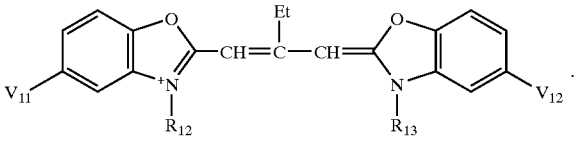

$R_{12}$ and $R_{13}$ independently represents substituted 1–6 carbon alkyl groups comprising an acid salt substiutuent as described above for $R_2$ and $R_3$. $V_{11}$ and $V_{12}$ independently represents halogens, and $M_{11}$ is a counterion to balance the charge such as described for M.

The following are non-limiting examples of dyes of structure (I):

I-1

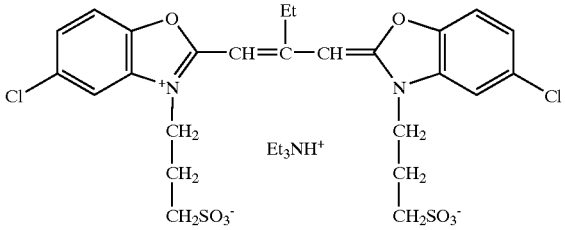

I-2

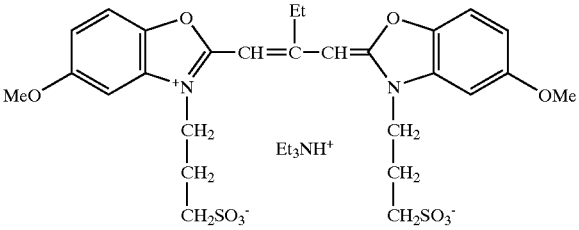

I-3

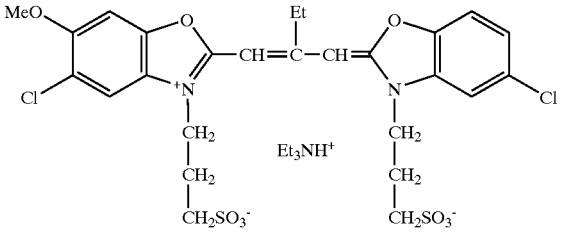

I-4

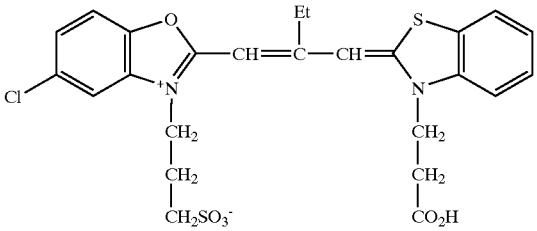

-continued

I-5

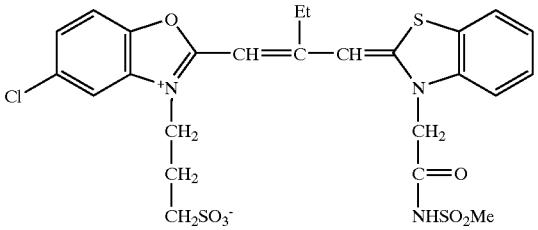

I-6

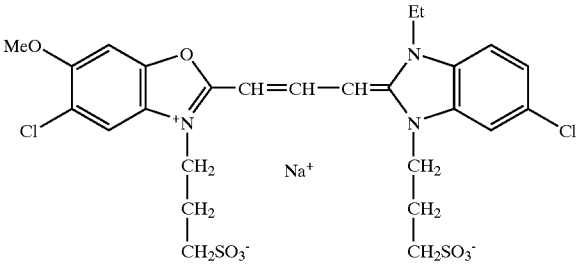

I-7

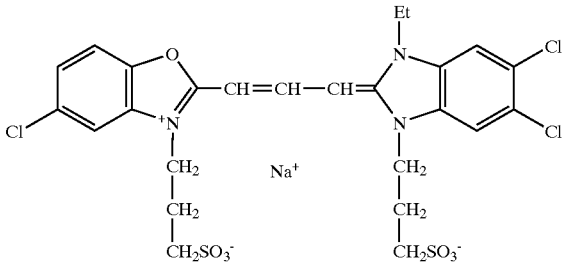

I-8

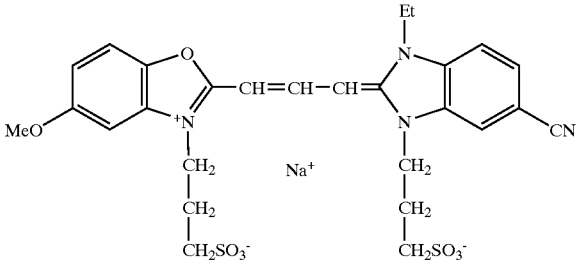

I-9

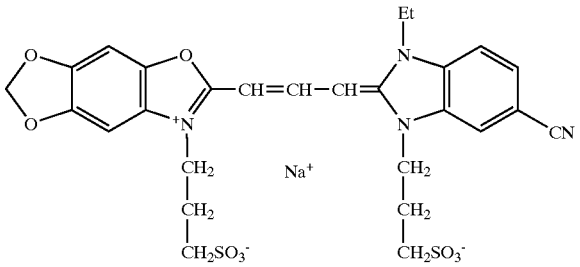

-continued

I-10

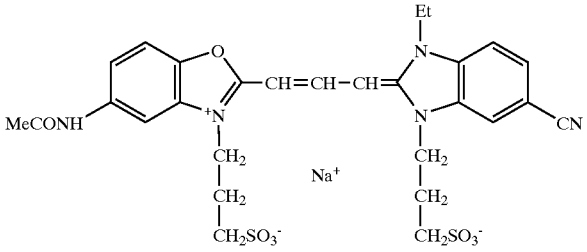

I-11

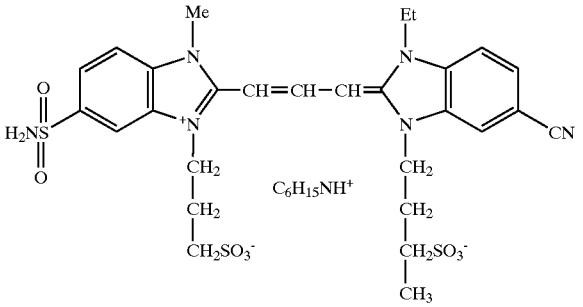

I-12

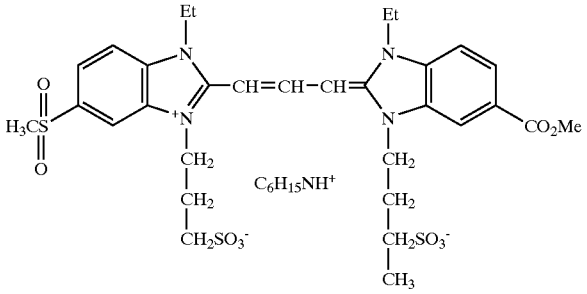

I-13

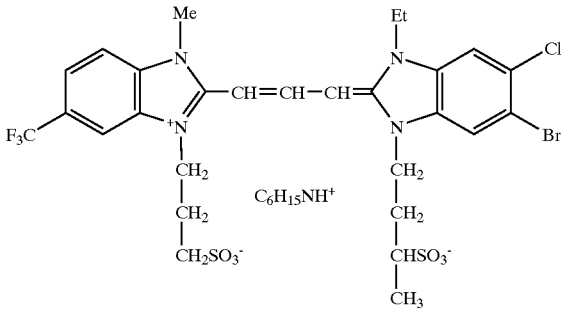

The dyes of structure (II) are as follows:

(II)

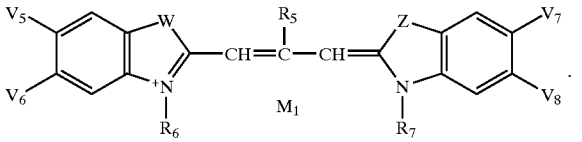

W is O, S, Se, or $NR_4$; making the ring a benzoxazole, benzothiazole, benzoselenazole, or benzimidazole ring. Z is S, or Se, making the second ring a benzothiazole or benzoselenazole ring. $R_5$ is H, or a 1–4 carbon alkyl group, for example, methyl, ethyl, or propyl, with ethyl being preferred. The alkyl group may be a chain or branched group.

$R_6$ and $R_7$ are independently 1–6 carbon alkyl groups comprising an acid salt substituent. $R_6$ and $R_7$ may be further substituted. Examples of acid salt substituents are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to, 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, and methanesulfonylcarbamoylmethyl. $R_4$ is a 1–4 carbon alkyl group.

In structure II, $V_5$ to $V_8$ are hydrogen or substituents with a pi constant of less than 0.75 provided that at least three of $V_5$ to $V_8$ are hydrogen or substituents with a pi constant of 0.65 or less. More preferably three of the substituents should have a pi constant of 0.60 to −2.0. Most preferably three of the substituents should have a pi constant of 0.55 to −2.0. $M_1$ represents a counterion to balance the charge of the acid salt substituents. M may be an inorganic or organic cation, but is preferably a monovalent metal cation or an ammonium ion, for example, lithium, sodium, or potassium ions, triethylammonium, tetrabutylammonium, and tetramethylguanidinium.

In a preferred embodiment, the dye of formula II can be represented by formula (IIb):

(IIb)

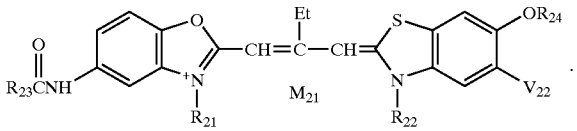

$R_{21}$ and $R_{22}$ independently represents substituted 1–6 carbon alkyl groups comprising an acid salt substiutuent as described above for $R_6$ and $R_7$. $R_{23}$ and $R_{24}$ independently represents substituted or unsubstituted 1–6 carbon alkyl groups. $V_{22}$ represents a halogen, and $M_{21}$ is a counterion to balance the charge as described for $M_1$.

The following are non-limiting examples of dyes of structure (II):

II-1

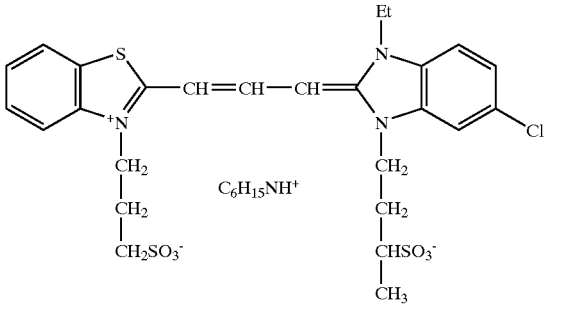

-continued

II-2

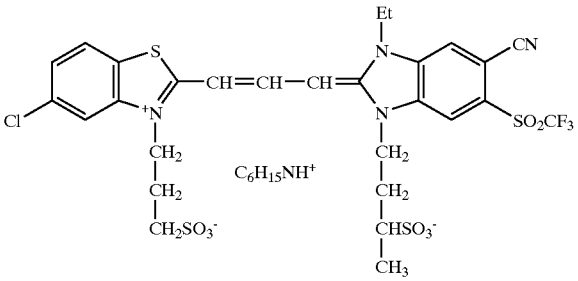

II-3

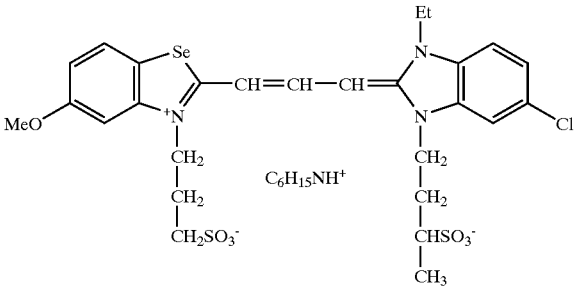

II-4

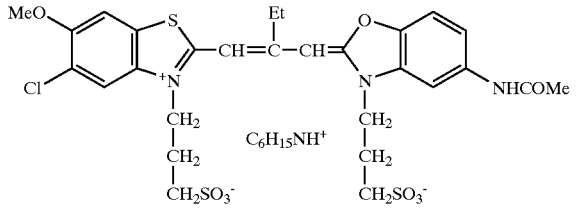

II-5

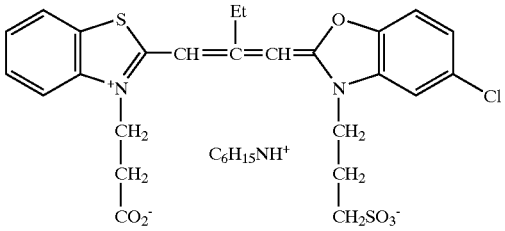

II-6

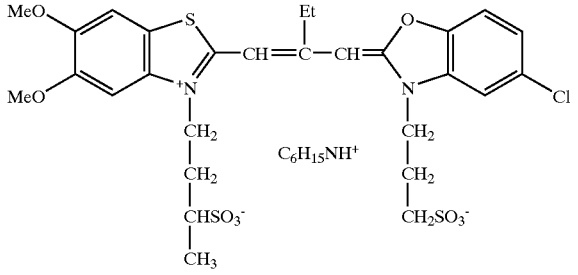

-continued

II-7

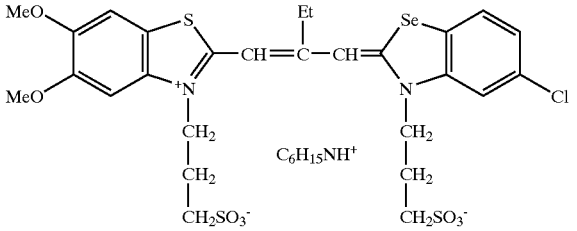

II-8

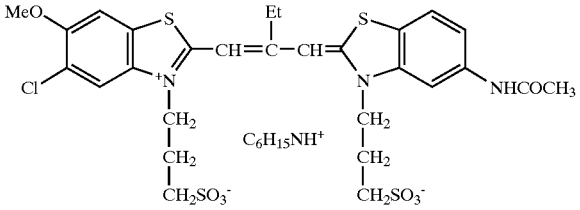

II-9

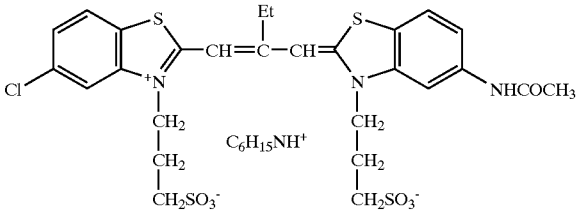

II-10

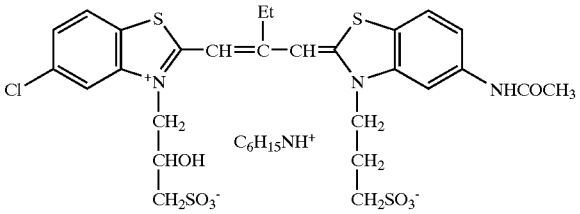

Hydrophobicity constants describe the relative tendency of a functional group to favor an oil (octanol) or water phase. Positive numbers indicate a preference for octanol, while negative numbers favor water. The larger the number, the stronger the preference for the oil phase. Hydrophobicity constants for common substituents have been tabulated in Leo and Hansch, "Substituent Constants for Correlation Analysis in Chemistry and Biology," Wiley, New York, 1979, and in Leo, Hansch, and Elkins, *Chem. Rev.*, 6, 525, (1971). Representative examples of pi values for some common dye substituents are listed in Table A.

TABLE A

Examples of substituent pi values.

| Substituent | pi value |
|---|---|
| $C_6H_5$ | 1.96 |
| $CF_3$ | 0.88 |
| Br | 0.86 |
| Cl | 0.71 |
| $SCH_3$ | 0.61 |
| $CH_3$ | 0.56 |
| F | 0.14 |

TABLE A-continued

| Examples of substituent pi values. | |
|---|---|
| Substituent | pi value |
| $OCH_3$ | −0.02 |
| $NHCOCH_3$ | −0.97 |

In one embodiment of this invention, the dye having at least one substituent that has a positive charge (Dye 2 of the dye layered emulsion) is represented by formula (III):

(III)

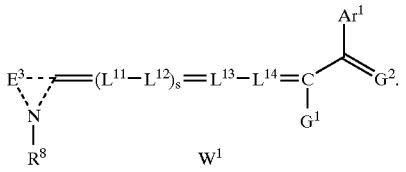

$R^8$ is a substituted or unsubstituted alkyl or aryl group comprising at least one cationic substituent and which may be further substituted. In one preferred embodiment $R^8$ of formula III does not contain an aromatic or heteroaromatic group. These groups can sometimes increase dye stain. A cationic substituent includes a substituent that can be protonated to become a cationic substituent. Examples of positively charged substituents are 3-(trimethylammonio) propyl), 3-(4-ammoniobutyl), and 3-(4-guanidinobutyl). Other examples are any substitutents that take on a positive charge in the silver halide emulsion melt, for example, by protonation such as aminoalkyl substitutents, e.g., 3-(3-aminopropyl), 3-(3-dimethylaminopropyl), and 4-(4-methylaminopropyl).

$E^3$ represents the atoms necessary to complete a substituted or unsubstituted 5- or 6-membered heterocyclic nucleus. These include, but are not limited to, a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art. Examples of useful nuclei for $E^3$ include a thiazole nucleus, e.g., thiazole, 4-methylthiazole, 4-phenylthiazole, 5-methylthiazole, 5-phenylthiazole,-4,5-dimethyl-thiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methylbenzothiazole, 5-methylbenzotbiazole, 6-methylbenzothiazole, 5-bromobenzothiazole, 6-bromobenzothiazole, 5-phenylbenzothiazole, 6-phenylbenzothiazole, 4-methoxybenzothiazole, 5methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-bydroxybenzothiazole, 6-ethoxy-5-hydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7',6'-4,5-thiazole, etc.; an oxazole nucleus, e.g., 4-methyloxazole, 5-methyloxazole, 4-phenyloxazble, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6hydroxybenzoxazole, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, and naphtho[1,2-d]selenazole; a pyridine nucleus, e.g., 2-pyridine, 5-methyl-2-pyridine, 4-pyridine, 3-methyl4-pyridine, and 3-methyl-4-pyridine; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, and 8-chloro-4-quinoline; a tellurazole nucleus, e.g., benzotellurazole, naphtho[1,2-d]benzotellurazole, 5,6-dimethoxybenzotellurazole, 5-methoxybenzotellurazole, 5-methylbenzotellurazole; a thiazoline nucleus, e.g., thiazoline, and 4-methylthiazoline; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, and 5-methyl-1,3,4-thiadiazole. In one preferred embodiment, $E^3$ represents the atoms necessary to complete a substituted or unsubstituted benzoxazole, benzothiazole, or quinoline nucleus.

$Ar^1$ is a substituted or unsubstituted aryl group or a substituted or unsubstituted alkyl group. $L^{11}$ through $L^{14}$ are substituted or unsubstituted methine groups, and s is 0 or 1. $G^1$ is an electron-withdrawing group, and $G^2$ is O or dicyanovinyl ($C(CN)_2$). $W^1$ is a counterion if necessary.

In one preferred embodiment, $R_2$, $R_3$ of formula I and $R_6$, $R_7$ of formula II, and $R^8$ of formula III do not contain an aromatic or heteroaromatic group, the net charge of structure I is −1, the net charge of structure II is −1, and the net charge of structure III is +1.

In another embodiment, the dye having at least one substituent that has a positive charge can be represented by formula (IIIb).

(IIIb)

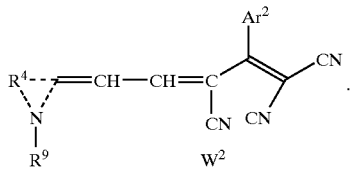

$R^9$ is an alkyl or aryl group that comprises at least one cationic substituent and which may be farther substituted. $E^4$ represents the atoms necessary to complete a substituted or unsubstituted benzoxazole, benzothiazole, or quinoline nucleus. $Ar^2$ is a substituted or unsubstituted aryl group, and $W^2$ is a counterion if necessary.

In another embodiment the dye having at least one substituent that has a positive charge can be represented by formula (IIIc).

(IIIc)

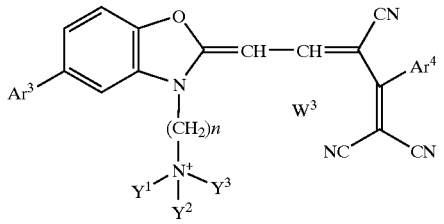

$Y^1$, $Y^2$, and $Y^3$ independently represents substituted or unsubstituted alkyl groups. $Ar^3$ and $Ar^4$ independently represents substituted or unsubstituted aromatic groups. n represents an integer from 3 to 5, and $W^3$ is a counterion.

In one preferred embodiment, a dye of formula (Ib), wherein $V_{11}$ and $V_{12}$ of formula (Ib) represent chloro, is used in combination with a dye of formula (IIIc), wherein $Y^1$, $Y^2$, and $Y^3$ of formula (IIIc) independently represents hydroxyethyl or methyl, $Ar^3$ and $Ar^4$ represent substituted or unsubstituted phenyl groups and n is 3 or 4. In another preferred embodiment a dye of formula (IIb), wherein $R_{23}$ and $R_{24}$ of formula (IIb) represent methyl, is used in combinations with a dye of formula (IIIc), wherein $Y^1$, $Y^2$ and $Y^3$ of formula (IIIc) independently represents hydroxyethyl or methyl, $Ar^3$ and $Ar^4$ represent substituted or unsubstituted phenyl groups, and n is 3 or 4.

In another embodiment the dye having at least one substituent that has a positive charge can be represented by formula (IIId), (IIId)

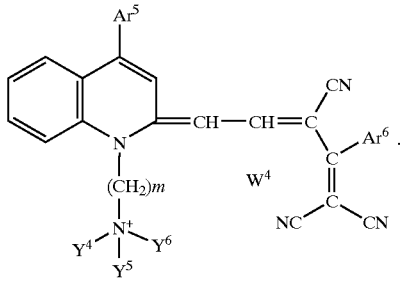

$Y^4$, $Y^5$, and $Y^6$ independently represents substituted or unsubstituted alkyl groups. $Ar^5$ represents a substituted or unsubstituted phenyl group, and the quinoline nucleus of formula (IIId) may be further substituted. $Ar^6$ represents a substituted or unsubstituted aromatic group. m represents an integer from 3 to 5, and $W^4$ is a counterion.

In one preferred embodiment a dye of formula (IIb), wherein $R_{23}$ and $R_{24}$ of formula (IIb) represent methyl, is used in combination with a dye of formula (IIId). In another preferred embodiment a dye of formula (Ib), wherein $V_{11}$ and $V_{12}$ of formula (Ib) represent chloro, is used in combination with a dye of formula (IIId).

The following are non-limiting examples of the dye having a cationic substituent (Dye 2). Preferred dyes are capable of absorbing light primarily in the region of 500 to 600 nm (green antenna dyes) or in the region of 600 to 700 nm (red antenna dyes).

III-1

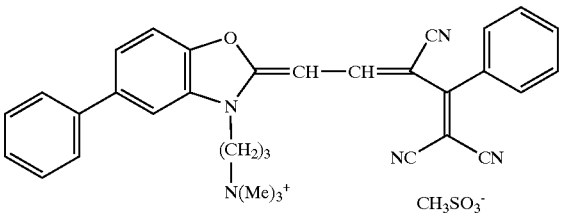

III-2

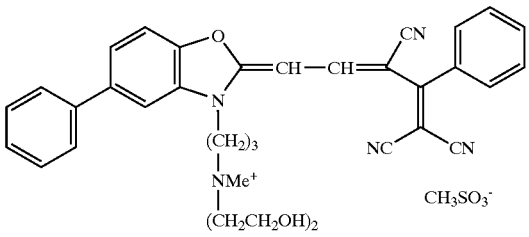

III-3

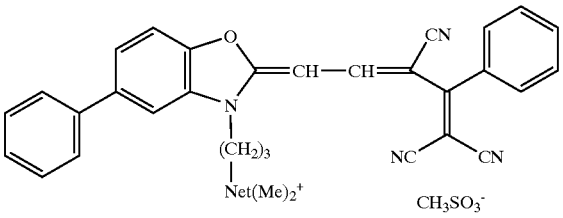

III-4

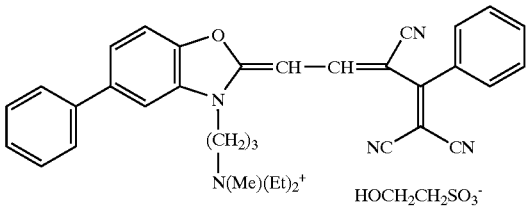

III-5

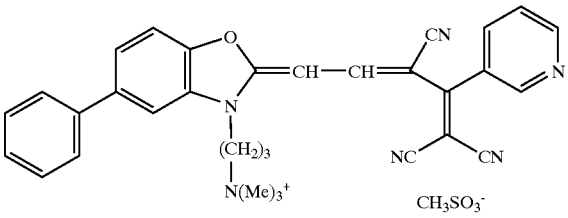

III-6

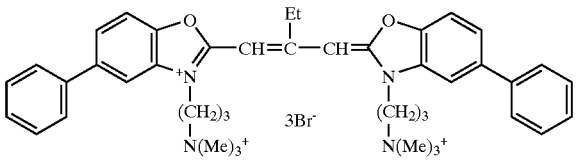

-continued
III-7
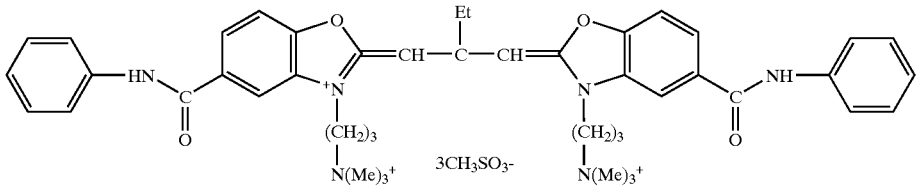
III-8
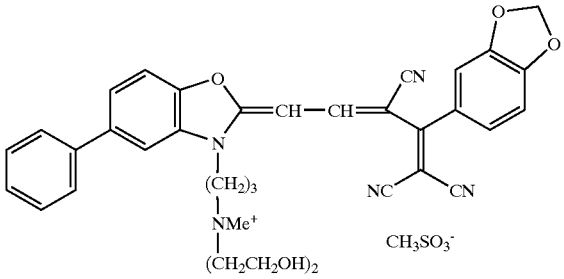
III-9
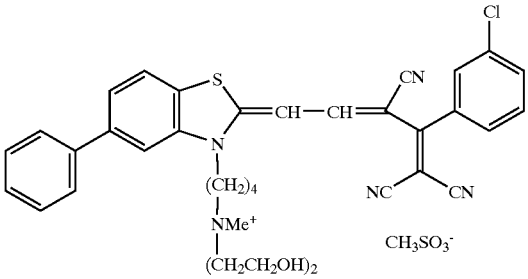
III-10
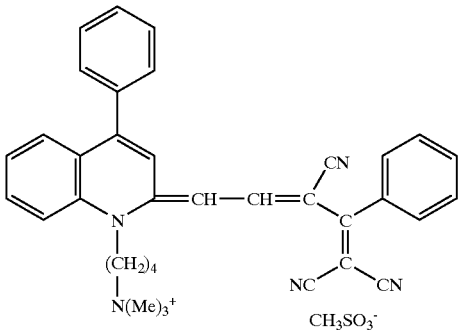
III-11
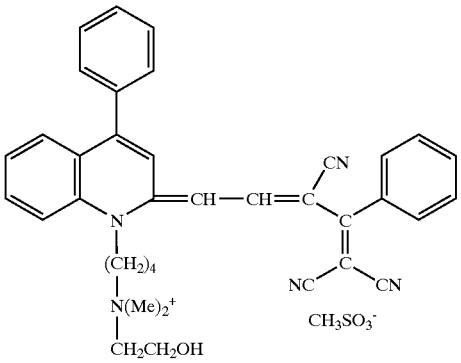
III-12
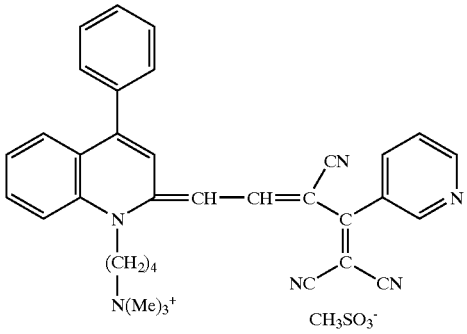
III-13
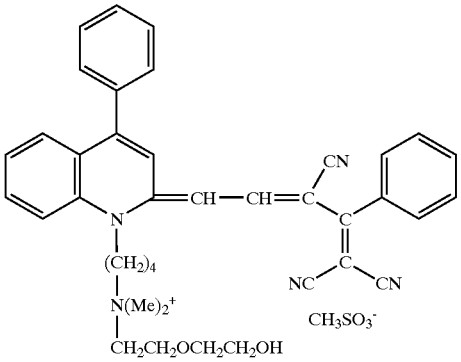
III-14
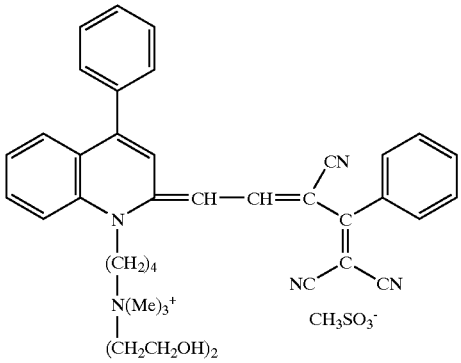

Dyes of formula I and II can be prepared by methods such as described in F. M. Hamer, *Cyanine Dyes and Related Compounds*, 1964 (publisher John Wiley & Sons, New York, N.Y.) and *The Theory of the Photographic Process*, 4th edition, T. H. James, editor, Macmillan Publishing Co., New York, 1977. Dyes of formula III can be prepared in a manner similar to the procedures described in U.S. Pat. No. 5,213,956.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxycthoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino,p-dodecylphenylcarbonyl amino, p-tolylcarbonylamino, N-methyl ureido, N,N-dimethyl ureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsul fonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quatemary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390, published by Kenneth Mason Publications, Ltd., Dudley Annex, 12a North Street, Emsworth, Hampshire PO107DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosur*, June 1994, Item 36230, provides suitable embodiments.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e., color negative, reversal, or direct positive processing) provided with the element. More preferably the elements are negative working. Suitable emulsions and their preparation, as well as methods of chemical and spectral sensitization, are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Pat. Nos. 1,466,728; 1,531,927; 1,533,039; 2,006,755 A and 2,017,704 A, the disclosures of which are incorporated herein by reference.

Image dye-forming couplers may be included in the element such as couplers that form cyan dyes upon reaction with oxidized color developing agents which are described in such representative patents and publications as U.S. Pat. Nos. 2,367,531; 2,423,730; 2,474,293; 2,772,162; 2,895,826; 3,002,836; 3,034,892; 3,041,236; 4,333,999; 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; 4,540,654; and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as U.S. Pat. Nos. 2,298,443; 2,407,210; 2,875,057; 3,048,194; 3,265,506; 3,447,928; 4,022,620; 4,443,536; and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers, any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58–113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0, although dispersions using no permanent coupler solvent are sometimes employed.

The invention materials may be used in association with materials that accelerate or otherwise modify the processing steps, e.g., of bleaching or fixing to improve the quality of the image. Bleach accelerator releasing couplers such as those described in EP 193 389; EP 301 477; and U.S. Pat. Nos. 4,163,669; 4,865,956; and 4,923,784 may be useful. Also contemplated is use of the compositions in association with nucleating agents, development accelerators or their precursors (U.K. Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions, or as solid particle dispersions. Additionally, they may be used with "smearing" couplers (e.g., as described in U.S. Pat. No. 4,366,237; EP 96 570; U.S. Pat. No. 4,420,556; and U.S. Pat. No. 4,543,323.) Also, the compositions may be blocked or coated in protected form as described, for example, in Japanese Application 61/258249 or U.S. Pat. No. 5,019,492.

The invention materials may further be used in combination with image-modifying compounds such as "Developer Inhibitor-Releasing" compounds (DIR's ). DIR's useful in conjunction with the compositions of the invention are known in the art, and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416, as well as the following European Patent Publications: 272 573; 335 319; 336 411; 346 899; 362 870; 365 252; 365 346; 373 382; 376 212; 377 463; 378 236; 384 670; 396 486; 401 612; and 401 613.

Such compounds are also disclosed in "Developer-Inhibitor-Releasing (DIR) Couplers for Color Photography," C. R. Barr, J. R. Thirtle, and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles, or benzisodiazoles. In a preferred embodiment, the inhibitor moiety or group is selected from the following formulas:

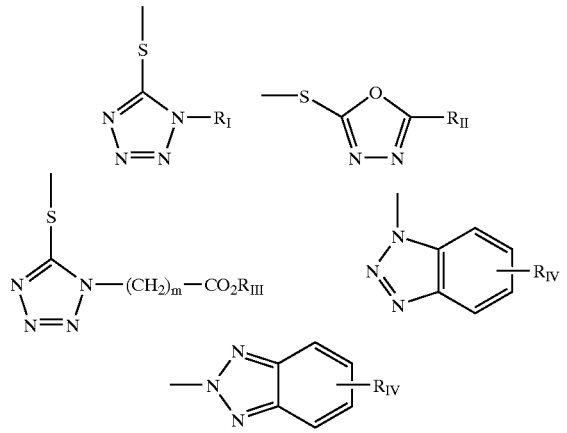

wherein $R_I$ is selected from the group consisting of straight- and branched-alkyls of from 1 to about 8 carbon atoms, benzyl, phenyl, and alkoxy groups and such groups containing none, one, or more than one such substituent; $R_{II}$ is selected from $R_I$ and —$SR_I$; $R_{III}$ is a straight- or branched-alkyl group of from 1 to about 5 carbon atoms and m is from 1 to 3; and $R_{IV}$ is selected from the group consisting of hydrogen, halogens and alkoxy, phenyl, and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; and 4,861,701, Japanese Applications 57-188035; 58-98728; 58-209736; and 58-209738); groups that function as a coupler or reducing agent after the coupler reaction (U.S. Pat. No. 4,438,193; U.S. Pat. No. 4,618,571)

and groups that combine the features described above. It is typical that the timing group is of one of the formulas:

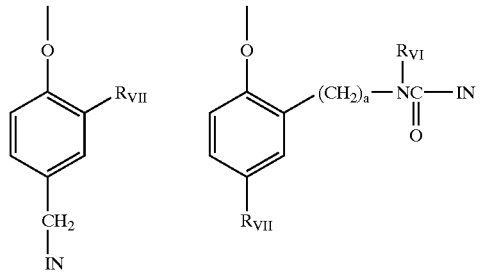

wherein IN is the inhibitor moiety, $R_{vII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464 612, EP 523 451, U.S. Pat. No. 4,146,396, Japanese Kokai 60–249148 and 60–249149.

Suitable developer inhibitor-releasing couplers for use in the present invention include, but are not limited to, the following:

D1

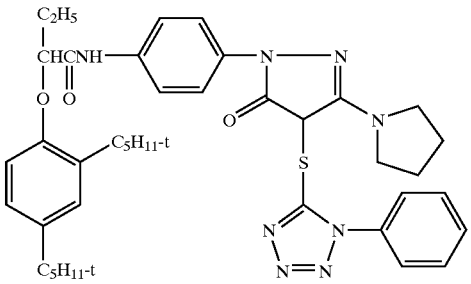

D2

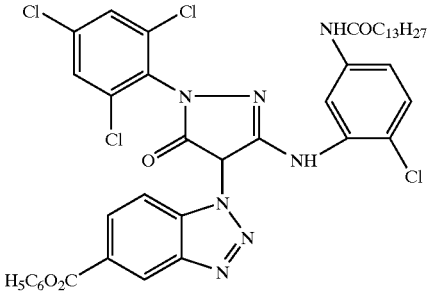

-continued

D3

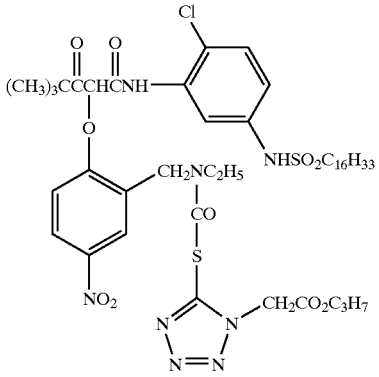

D4

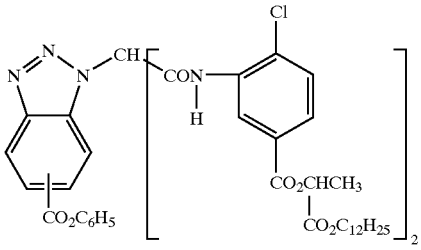

D5

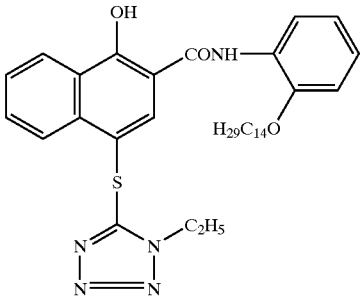

D6

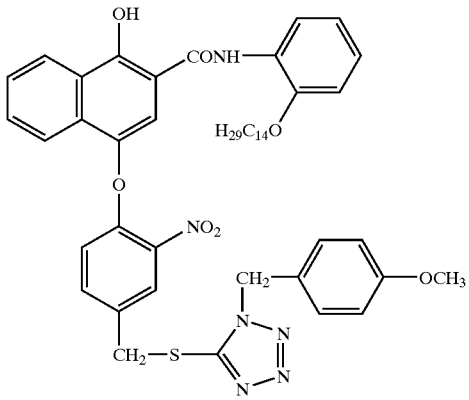

-continued

D7

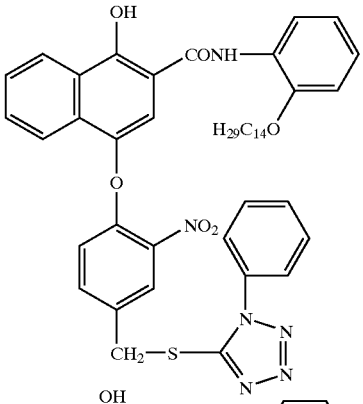

D8

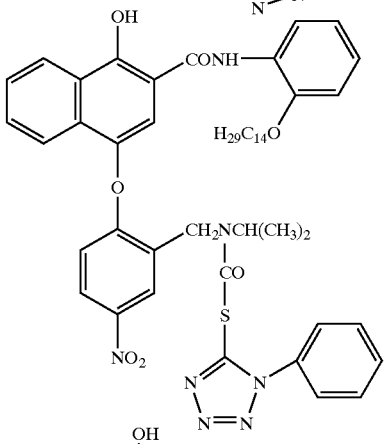

D9

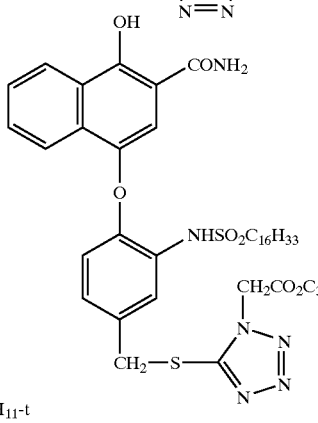

D10

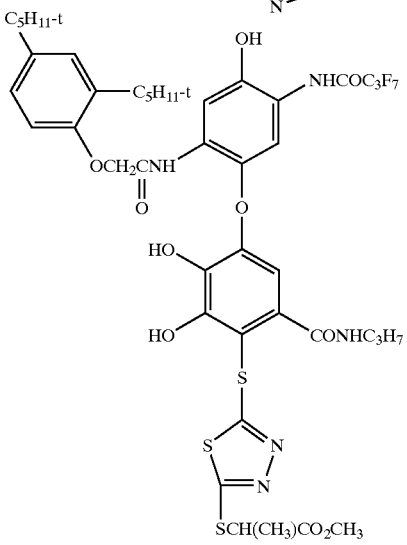

-continued

D11

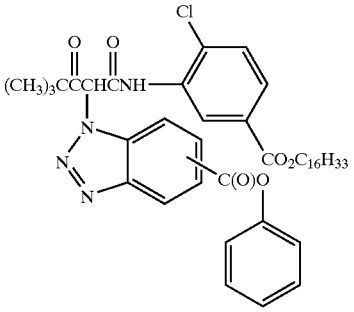

D12

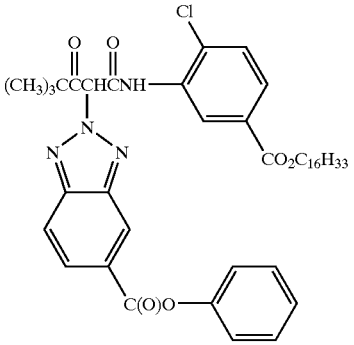

The silver halide used in the photographic elements may be silver iodobromide, silver bromide, silver chloride, silver chlorobromide, and silver chloroiodobromide. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process*, $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, and pH values at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride, and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are hereby incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide, and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin—that is, their average thickness is less than 0.07 $\mu$m.

The useful average grain ECD of a tabular grain emulsion can range up to about 15 $\mu$m. Except for a very few high speed applications, the average grain ECD of a tabular grain emulsion is conventionally less than 10 $\mu$m, with the average grain ECD for most tabular grain emulsions being less than 5 $\mu$m.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215; Wey et al U.S. Pat. No. 4,414,306; Maskasky U.S. Pat. Nos. 4,400,463; 4,713,323; 5,061,617; 5,178,997; 5,183,732; 5,185,239; 5,399,478; and 5,411,852; Maskasky et al U.S. Pat. Nos. 5,176,992 and 5,178,998; Takada et al U.S. Pat. No. 4,783,398; Nishikawa et al U.S. Pat. No. 4,952,508; Ishiguro et al U.S. Pat. No. 4,983,508; Tufano et al U.S. Pat. No. 4,804,621; Maskasky and Chang U.S. Pat. No. 5,178,998; and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992; 5,221,602; 5,298,387; and 5,298,388, the disclosures of which are hereby incorporated by reference.

Preferred high chloride tabular grain emulsions are {100} tabular grain emulsions, as illustrated by the following patents, here incorporated by reference: Maskasky U.S. Pat. Nos. 5,264,337; 5,292,632; 5,275,930; 5,607,828 and 5,399,477; House et al U.S. Pat. No. 5,320,938; Brust et al U.S. Pat. No. 5,314,798; Szajewski et al U.S. Pat. No. 5,356,764; Chang et al U.S. Pat. Nos. 5,413,904; 5,663,041; and 5,744,297; Budz et al U.S. Pat. No. 5,451,490; Reed et al U.S. Pat. No. 5,695,922; Oyamada U.S. Pat. No. 5,593,821; Yamashita et al U.S. Pat. Nos. 5,641,620; and 5,652,088; Saitou et al U.S. Pat. No. 5,652,089; and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; 4,173,320; and 5,411,851; 5,418,125; 5,492,801; 5,604,085; 5,620,840; 5,693,459; 5,733,718; Daubendiek et al U.S. Pat. Nos. 4,414,310 and 4,914,014; Sowinski et al U.S. Pat. No. 4,656,122; Piggin et al U.S. Pat. Nos. 5,061,616 and 5,061,609, Tsaur et al U.S. Pat. Nos. 5,147,771; '772; '773; 5,171,659; and 5,252,453; Black et al 5,219,720 and 5,334,495; Delton U.S. Pat. Nos. 5,310,644; 5,372,927; and 5,460,934, Wen U.S. Pat. No. 5,470,698; Fenton et al U.S. Pat. No. 5,476,760; Eshelman et al U.S. Pat. Nos. 5,612,175; 5,612,176; and 5,614,359; and Irving et al U.S. Pat. Nos. 5,695,923; 5,728,515; and 5,667,954; Bell et al U.S. Pat. No. 5,132,203; Brust U.S. Pat. Nos. 5,248,587; and 5,763,151; Chaffee et al U.S. Pat. No. 5,358,840; Deaton et al U.S. Pat. No. 5,726,007; King et al U.S. Pat. No. 5,518,872; Levy et al U.S. Pat. No. 5,612,177; Mignot et al U.S. Pat. No. 5,484,697; Olm et al U.S. Pat. No. 5,576,172; Reed et al U.S. Pat. Nos. 5,604,086; and 5,698,387.

Ultrathin high bromide {111} tabular grain emulsions are illustrated by Daubendiek et al U.S. Pat. Nos. 4,672,027; 4,693,964; 5,494,789; 5,503,971; and 5,576,168; Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al, and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al, and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges. The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti, et al., U.S. Pat. No. 4,937,180; and Johnson et al U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure*, Item 36736, published November 1994, here incorporated by reference. SET dopants are known to be effective to reduce reciprocity failure. In particular the use of $Ir^{+3}$ or $Ir^{+4}$ hexacoordination complexes as SET dopants is advantageous. Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is hereby incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in *The British Journal of Photography Annual* of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

- 4-amino-N,N-diethylaniline hydrochloride,
- 4-amino-3-methyl-N,N-diethylaniline hydrochloride,
- 4-amino-3-methyl -N-ethyl-N-(2-methanesulfonamidoethyl)aniline sesquisulfate hydrate,
- 4-amino-3-methyl-N-ethyl-N-(2-hydroxyethyl)aniline sulfate,
- 4-amino-3-(2-methanesulfonamidoethyl)-N,N-diethylaniline hydrochloride and
- 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention.

PHOTOGRAPHIC EXAMPLE 1

An emulsion that contained $AgBr_{96.4}I_{3.7}$ tabular grains exhibiting a mean equivalent circular diameter of 2.1 $\mu$m and a mean thickness of 0.13 $\mu$m was prepared. The tabular grains accounted for greater than 90 percent of the total grain projected area. The emulsion was separated into parts (A–D), and each emulsion part was sensitized as follows: An aqueous solution containing 100 mg/mole of sodium thiocyanate and 35 mg/mole of benzothiazolium tetrafluoroborate was added to samples of the emulsion at 40° C. A sensitizing dye combination (1.0 mmole/Ag-mole) was then added (see Table EX1-1). Gold and sulfur containing chemical sensitizers were added at levels to provide substantially optimum sensitizations. The emulsions were digested at 60° C. for 5 to 20 minutes. The temperature was reduced to 40° C. and the antenna dye, III-2 (1.2 mmole/Ag-mole) was then added except for emulsion A. Additional gelatin was then added along with 4-hydroxy-6-methyl-1,3,3a,7-tetraazaindine.

Emulsions sensitized as described above were coated on a cellulose acetate photographic support that had an antihalation backing and a gelatin subbing layer. The emulsion laydown was 1.076 g Ag/m$^2$. The emulsions so coated were developed for 3 minutes and 15 seconds using the Kodak Flexicolor™ color negative process. The resultant dye stain was then measured on a spectrophotometer, recording the optical density at the peak wavelength of 510 nm.

Dye A

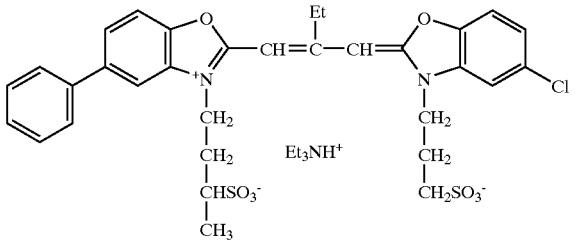

Dye B

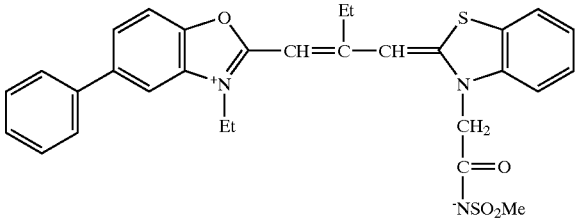

The examples in Table EX1-1 show that the proper choice of a sensitizing dye combination in the first dye layer, when used with an antenna dye in the second dye layer, can avoid a significant increase in dye stain relative to an emulsion that does not have an antenna dye present. The post-process optical density of coatings containing Emulsion A and B represent the standard dye stain and the increase observed from the addition of the antenna dye. Emulsion C contains the inventive dyes in combination with an antenna dye. The use of Dyes I-1 and I-4 permit the addition of the antenna dye with a residual dye stain which is similar to the stain of an emulsion without the antenna dye present (C vs. A). Both emulsions C and B have antenna dyes present, but the stain associated with Emulsion C is significantly less then that for Emulsion B. Emulsion D also shows a similar reduction in dye stain compared to emulsion B, using Dye I-1 alone.

TABLE EX 1-1

| Example | Emulsion | Dye Combination | Antenna Dye (III-2) | Density of Residual Dye Stain (510 nm) | Relative Dye Stain |
|---|---|---|---|---|---|
| 1-1 | A | Dye A (80%) Dye B (20%) | No | 0.075 | |
| 1-2 (Comparison) | B | Dye A (80%) Dye B (20%) | Yes | 0.135 | 100 |
| 1-4 (Invention) | C | Dye I-1 (80%) I-4 (20%) | Yes | 0.080 | 59 |
| 1-6 (Invention) | D | Dye I-1 (80%) Dye B (20%) | Yes | 0.082 | 61 |

PHOTOGRAPHIC EXAMPLE 2

Samples of a 3.7 mole-% dump iodide tabular grain emulsion of dimensions 3.9 $\mu$m equivalent circular diameter and 0.13 $\mu$m thickness were sensitized with dye combinations W, X, Y, and Z (see Table EX2-1 below). Changing the dyes or dye ratios shifts the maximum absorption wavelength of the dye combination as shown in the Table. All the emulsions were given the same treatment, after dye addition, of gold and sulfur chemical sensitizer levels consisting of 3.13 $\mu$mole/Ag-mole of Au ($Na_3Au(S_2O_3)_2$) and 9.39 $\mu$mole/Ag-mole of S (via $(S_2O_3)_2$ and gold sensitizer ligands) and used 1.15 g/Ag-mole of 5-methyl-tetraazaindine (sodium salt) as an antifoggant. The finish conditions were 65° C. for 15 minutes (except for dye set W, which used 60° C.). The emulsions were then held at 43° C., and each was then treated with red antenna dye III-10 at a level of 1.25 mmoles/Ag-mol or 1.75 mmol/Ag-mol (Table EX-2).

The sensitized emulsions were coated in single layers at 0.65 g/m$^2$ (60 mg/ft$^2$) of Ag and 0.75 g/m$^2$ (70 mg/ft$^2$) of a cyan coupler, 2-(2,4-bis(1,1-dimethylpropyl)phenoxy)-N-(4-((((4-cyanophenyl)amino)carbonyl) amino)-3-hydroxyphenyl)-hexanamide, on an antihalation containing estar support and with 2.15 g/m$^2$ (200mg/ ft$^2$) gel overcoat (1.75% 1,1'-(methylenebis(sulfonyl))bisethene, hardener). Test for dye stain was done by processing in a developer-free pH-10 buffer solution for 3.25 minutes, followed by a bleach-wash-fix-wash cycle of 4'/3'/4'/4' respectively. The differences in dye stain are shown in Table EX2-2 below.

The Table demonstrates that this approach of employing a lower-staining (and shorter red—for enhanced color reproduction) base finish on the same grain as the layering dye, does reduce the amount of dye stain. The speed advantage from forming two dye layers is maintained, as shown in Table EX2-3, which compares the speed of emulsions sensitized with dye combinations X, Y, and Z with and without the antenna dye III-10.

TABLE EX 2-1

The dye combinations W, X, Y, Z, and AA.

| Dye Set | Component 1 | % | Component 2 | % | Component 3 | % | Total Dye[4] | λmax nm |
|---|---|---|---|---|---|---|---|---|
| W[1] | Dye C | 82 | Dye D | 13 | Dye E | 5 | 0.833 | 648 |
| X[2] | Dye II-4 | 69 | Dye C | 28 | Dye E | 3 | 1.00 | 628 |
| Y[2] | Dye II-4 | 58 | Dye C | 39 | Dye E | 3 | 1.00 | 632 |
| Z[2] | Dye II-4 | 49 | Dye C | 48 | Dye E | 3 | 1.00 | 638 |
| AA[3] | Dye G | 78 | Dye H | 19 | Dye E | 1 | 0.860 | |

[1]Dye-E added first.

[2]Dye-E was added first, Dye-II-4 and Dye-C were premixed and then added.

[3]Dye-E was added first, Dye-G and Dye-H were premixed and then added.

[4]mmoles of dye per Ag-mole.

TABLE EX 2-2

Dye stain comparisons.

| Example | | Dye Set | III-10 (mmol) | Optical Density | Relative Dye Stain |
|---|---|---|---|---|---|
| 2-1 | Comparison | W | 1.50 | 0.161 | 100 |
| 2-2 | Invention | X | 1.50 | 0.094 | 58 |
| 2-3 | Invention | Y | 1.50 | 0.102 | 63 |
| 2-4 | Invention | Z | 1.50 | 0.125 | 78 |
| 2-5 | Comparison | w | 1.75 | 0.172 | 100 |
| 2-6 | Invention | X | 1.75 | 0.105 | 61 |
| 2-7 | Invention | Y | 1.75 | 0.125 | 73 |
| 2-8 | Invention | Z | 1.75 | 0.144 | 84 |

TABLE EX2-3

Photographic speed comparisons.

| Example | | Dye Set | III-10 (mmol) | Relative Speed |
|---|---|---|---|---|
| 2-9 | Comparison | X | 0 | 100 |
| 2-10 | Invention | X | 1.75 | 120 |
| 2-11 | Comparison | Y | 0 | 100 |
| 2-12 | Invention | Y | 1.75 | 115 |
| 2-13 | Comparison | Z | 0 | 100 |
| 2-14 | Invention | Z | 1.75 | 132 |

Dye-C

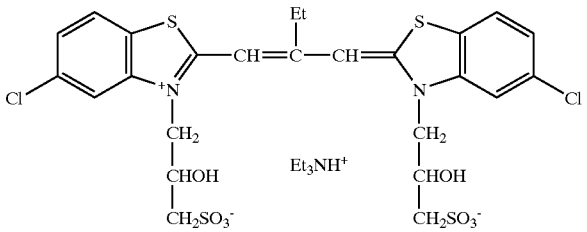

Dye-D

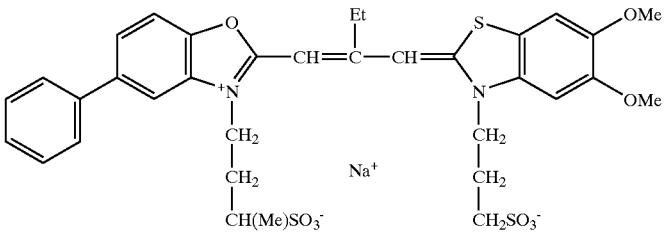

Dye-E

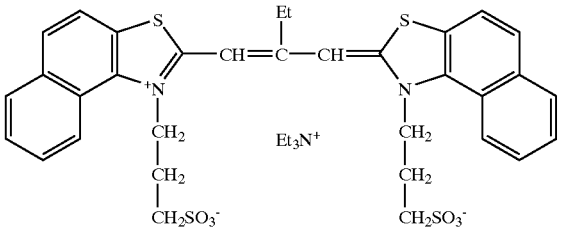

Dye G

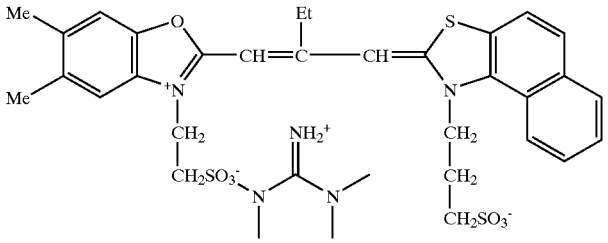

Dye H

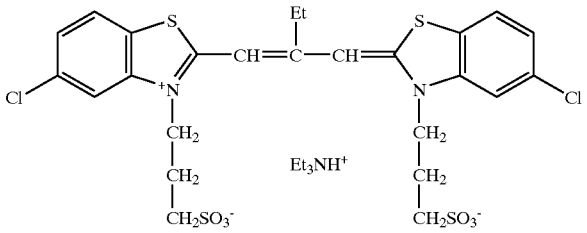

PHOTOGRAPHIC EXAMPLE 3

As shown in Table EX3-1, a series of emulsions were prepared and sensitized with various dye combinations (see Table EX2-1). The emulsions were also optimally chemically sensitized with gold and sulfur. The emulsions were coated in a multilayer format (Table EX3-2) having three light-sensitive layers, an 'ultra-fast' layer containing a very large emulsion (Emulsion 3 or 4), a 'fast' layer containing a large emulsion (Emulsion 5 or 6), a layer containing a mid-sized emulsion (Emulsion 7 or 8), and a small emulsion (Emulsion 9). The ultra-fast layer contains a red sensitized emulsion with a red antenna dye. The coatings were processed and evaluated for optical density due to retained dye. The examples 3-2 and 3-4 relative to 3-1 and 3-3 respectively indicate that stain can be reduced by using a dye according to the invention in the mid-layers of a multilayer photographic element in combination with another layer that has a larger, more light-sensitive emulsion and more than one dye layer.

TABLE EX 3-1

| Emulsion | Size | mole - % Iodide | Dye Set | Antenna Dye III-10 |
|---|---|---|---|---|
| 1 | 3.6 μm ecd × 0.12 μm thick | 3.7 | W (0.813 mmol) | No |
| 2 | 3.6 μm ecd × 0.12 μm thick | 3.7 | W (0.813 mmol) | 2.0 mmol |
| 3 | 2.5 μm ecd × 0.12 μm thick | 3.7 | X (1.05 mmol) | No |
| 4 | 2.5 μm ecd × 0.12 μm thick | 3.7 | AA (0.860 mmol) | No |

TABLE EX 3-1-continued

| Emulsion | Size | mole - % Iodide | Dye Set | Antenna Dye III-10 |
|---|---|---|---|---|
| 5 | 1.4 μm ecd × 0.12 μm thick | 3.7 | W (1.00 mmol) | No |
| 6 | 1.6 μm ecd × 0.12 μm thick | 3.7 | X (1.00 mmol) | No |
| 7 | 0.8 μm ecd × 0.10 μm thick | 3.7 | W 1.0 mmol | No |
| 8 | 1.2 μm ecd × 0.10 μm thick | 3.7 | X 1.0 mmol | No |
| 9 | 0.6 μm ecd × 0.08 μm thick | 3.0 | W 1.0 mmol | No |

TABLE EX 3-2

| LAYER | COMPONENT | LEVEL | COMPONENT | LEVEL |
|---|---|---|---|---|
| OVERCOAT | HARDENER-1 | 1.75% | SURFACTANT-1 | |
| | GELATIN | 250 mg/ft$^2$ | SURFACTANT-2 | |
| | EMULSION-1 | 1075.8 mg/m$^2$ | GELATIN | 1150 mg/m$^2$ |
| ULTRA FAST LAYER | COUPLER-1 | 22.0 mg/m$^2$ | ANTIFOGGANT-1 | 12.1 g/mole |
| | COUPLER-2 | 806.88 mg/m$^2$ | ANTIFOGGANT-2 | 10 g/mole |
| | SCAVENGER-1 | 14.0 mg/m$^2$ | ANTIFOGGANT-3 | 3.2 g/mole |
| | COUPLER-3 | 50 mg/m$^2$ | | |
| | EMULSION (-3 or -4) | 1070 mg/m$^2$ | ANTIFOGGANT-1 | 8.6 g/mole |
| FAST LAYER | COUPLER-2 | 230 mg/m$^2$ | FOGGANT-3 | 6.5 g/mole |
| | COUPLER-4 | 54 mg/m$^2$ | GELATIN | 1050 mg/m$^2$ |
| | COUPLER-5 | 7.5 mg/m$^2$ | | |
| | EMULSION (-5 or -6) | 518 mg/m$^2$ | GELATIN | 2720 mg/m$^2$ |
| MID And SLOW LAYER | EMULSION (-7 or -8) | 490 mg/m$^2$ | ANTIFOGGANT-1 | 8.64 g/mole |
| | EMULSION-9 | 65 mg/m$^2$ | DD-1 | 22.0 mg/m$^2$ |
| | COUPLER-4 | 43.0 mg/m$^2$ | OH-1 | 50 g/mole |
| | COUPLER-2 | 491 mg/m$^2$ | GELATIN | 6.78% |
| | COUPLER-6 | 339 mg/m$^2$ | COUPLER-7 | 32.0 mg/m$^2$ |
| | COUPLER-5 | 97.0 mg/m$^2$ | CMP-1 | 10 g/mole |
| SUPPORT | ANTIHALATION | | | |

| Component | Description |
|---|---|
| HARDENER-1 | 1,1'-(methylenebis(sulfonyl))bisethene |
| GELATIN | Bone gelatine (non-deionized) |
| SURFACTANT-1 | 2-(2-(4-(1,1,3,3-tetramethylbutyl)phenoxy)ethoxy)ethanesulfonic acid, sodium salt |
| SURFACTANT-2 | p-nonyl phenoxy polyglycerol 50% |
| COUPLER-1 | 4-((1-ethyl-1H-tetrazol-5-yl)thio)-1-hydroxy-N-(2-(tetradecyloxy)phenyl)-naphthalenecarboxamide |
| COUPLER-2 | 2-(2,4-bis(1,1-dimethylpropyl)phenoxy)-N-(4-((((4-cyanophenyl) amino)carbonyl)amino)-3-hydroxyphenyl) hexanamide |
| COUPLER-3 | N-2-(dodecyloxy)-5-methylphenyl)-1-hydroxy-4-(2-nitro-4-(((1-phenyl-1H-tetrazole-5-yl)thio)methyl)phenoxy-2-naphthalenecarboxamide |
| COUPLER-4 | 5-(((4-((3-(((2-(dodecyloxy)-5-methylphenyl)amino)carbonyl)-4-hydroxy-1-naphthalenyl)oxy)-3-nitrophenyl)methyl)thio)-1H-tetrazole-1-acetic acid, propyl ester |
| COUPLER-5 | 3-((3-(((2-(dodecyloxy)-5-methylphenyl)amino)carbonyl)-4-hydroxy-1-naphthalenyl)thio)-propanoic acid |
| COUPLER-6 | 2-(2,4bis(1,1-dimethylpropyl)phenoxy)-N-(4-((((4-cyanophenyl)amino) carbonyl)amino)-5-hydroxy-2-(4-methoxyphenoxy)phenyl)-hexanamide |
| COUPLER-7 | 1-hydroxy-4444((14(4methoxyphenyl)xnethyl)-1H-tetrazol-5-yl)thio)methyl)-2-nitrophenoxy)-N-(2-(tetra-decyloxy)phenyl)-2-naphthalenecarboxamide |
| SCAVENGER-1 | 2,5-bis(1,1,3,3-tetramethylbutyl)-1,4-benzenediol |
| ANTIFOGANT-1 | 5-methyl-(1,2,4)Triazolo(1,5-a)pyrimidin-7-ol, sodium salt |

TABLE EX 3-2-continued

| | |
|---|---|
| ANTIFOGANT-2 | N-(3-(2,5-dihydro-5-thioxo-1H-tetrazol-1-yl)phenyl)-acetamide |
| ANTIFOGANT-3 | bis(monothiosulfato(2-)O,S)-aurate(3-), trisodium, dihydrate |
| DD-1 | 5-(acetylamino)-3-((4-(3-(((4-(2,4-bis(1,1-dimethyl-propyl)phenoxy)butyl)-aniino)carbonyl)-4-hydroxy-1-naphthalenyl)oxy)phenyl)azo)-4-hydroxy-naphthalenedisulfonic acid, disodium salt |
| OH-1 | sodium hydroxide (Na(OH)) |
| CMP-1 | 2,5-dihydroxy-4-(1-methylheptadecyl)-benzenesulfonic acid, monosodium salt |

TABLE EX3-3

| Example | Ultra-Fast Layer[1] | Fast Layer[1] | Mid Layer[1] | Slow Layer[1] | λmax[2] (nm) | Optical Density[2] | Relative Stain |
|---|---|---|---|---|---|---|---|
| 3-1 Comparison | Emul-2 (W, III-10) | Emul-3 (X) | Emul-5 (W)<br>Emul-7 (W) | Emul-9 (W) | 580 | 0.342 | 100 |
| 3-2 Invention | Emul-2 (W, III-10) | Emul-3 (X) | Emul-6 (X)<br>Emul-8 (X) | Emul-9 (W) | 580 | 0.284 | 83 |
| 3-3 Comparison | Emul-2 (W, III-10) | Emul-4 (AA) | Emul-5 (W)<br>Emul-7 (W) | Emul-9 (W) | 572 | 0.356 | 100 |
| 3-4 Invention | Emul-2 (W, III-10) | Emul-4 (AA) | Emul-6 (X)<br>Emul-8 (X) | Emul-9 (W) | 568 | 0.312 | 88 |

[1]Dye set is given in parenthesis.
[2]λmax and optical density of retained sensitizing dye.

PHOTOGRAPHIC EXAMPLE 4

A color negative multilayer film (sample 4-1) was prepared by coating the following layers in order on an undercoated cellulose triacetate support. In the table, the amount of high boiling solvents represents the total amount incorporated into that layer.

| Layer | Components | Amount (mg/m$^2$) |
|---|---|---|
| Antihalation layer | Gray silver | 172 |
| | Oxidized developer scavenger ODS-1 | 97 |
| | UV absorbing dye UV-1 | 75 |
| | UV absorbing dye UV-2 | 75 |
| | Development Accelerator DA-1 | 16 |
| | Yellow dye YD-1 | 65 |
| | Magenta dye MD-1 | 0.2 |
| | Cyan dye CD-1 | 0.2 |
| | Antifoggant AF-1 | 1.2 |
| | Antifoggant AF-2 | 0.715 |
| | Sequestrant SQ-1 | 7 |
| | Sequestrant SQ-2 | 265 |
| | Tris(2-ethylhexyl) phosphate | 145.5 |
| | Tricresyl phosphate | 156 |
| | N,N-dibutyldodecanamide | 32 |
| | Polyacrylamide latex | 64.6 |
| | Gelatin | 2368 |
| Slow red sensitive layer | Red sensitive emulsion A | 480 |
| | Red sensitive emulsion B | 120 |
| | Red sensitive emulsion C | 756 |
| | Cyan coupler CC-1 | 393 |
| | Cyan coupler CC-2 | 124 |
| | Cyan modifying coupler CMC-1 | 21 |
| | Cyan modifying coupler CMC-2 | 75 |
| | Cyan modifying coupler CMC-3 | 75 |
| | Magenta colored cyan coupler MCC-1 | 12 |
| | 2-phenoxyethanol | 2 |
| | 2,4-di-t-amylphenol | 124 |
| | Dibutyl sebacate | 620 |
| | N-butyl acetanilide | 181 |
| | Tricresyl phosphate | 84 |
| | N,N-diethyl lauramide | 97.5 |
| | Gelatin | 1950 |

-continued

| Layer | Components | Amount (mg/m$^2$) |
|---|---|---|
| Medium red sensitive layer | Red sensitive emulsion D | 900 |
| | Cyan coupler CC-1 | 92 |
| | Cyan coupler CC-2 | 25 |
| | Cyan modifying coupler CMC-1 | 17 |
| | Cyan modifying coupler CMC-2 | 10 |
| | Cyan modifying coupler CMC-3 | 50 |
| | Magenta colored cyan coupler MCC-1 | 48 |
| | Development accelerator DA-2 | 60 |
| | Di-t-amylphenol | 25 |
| | Dibutyl sebacate | 125 |
| | N-butyl acetanilide | 106.2 |
| | Tricresyl phosphate | 68 |
| | N,N-diethyl lauramide | 13 |
| Fast red sensitive layer | Red sensitive emulsion E | 800 |
| | Cyan coupler CC-1 | 124 |
| | Cyan coupler CC-2 | 10 |
| | Cyan modifyng coupler CMC-1 | 94 |
| | Development accelerator DA-2 | 60 |
| | Di-t-amylphenol | 10 |
| | Dibutyl sebacate | 50 |
| | N-butyl acetanilide | 2.5 |
| | Tricresyl phosphate | 376 |
| | Gelatin | 1120 |
| Inter-layer | Oxidized developer scavenger ODS-1 | 75 |
| | Tris(2-ethylhexyl) phosphate | 112.5 |
| | Antifoggant AF-3 | 0.7 |
| | Polystyrene matte beads | 25 |
| | Gelatin | 540 |
| Slow green sensitive layer | Green sensitive emulsion A | 150 |
| | Green sensitive emulsion B | 375 |
| | Magenta coupler MC-1 | 375 |
| | Yellow colored magenta coupler YMC-1 | 133.5 |
| | Tricresyl phosphate | 642 |
| | N-butyl acetanilide | 56.3 |
| | Antifoggant AF-2 | 0.2 |
| | Polyacrylamide latex | 20 |
| | Gelatin | 1184 |
| Medium green sensitive layer | Green sensitive emulsion C | 870 |
| | Magenta coupler MC-1 | 70 |
| | Yellow colored magenta coupler YMC-1 | 31.5 |
| | Oxidized developer scavenger ODS-2 | 20 |
| | Tricresyl phosphate | 133 |
| | N-butyl acetanilide | 10.5 |
| | Development accelerator DA-1 | 60 |
| | Gelatin | 1145 |

-continued

| Layer | Components | Amount (mg/m$^2$) |
|---|---|---|
| Fast green sensitive layer | Green sensitive emulsion D | 940 |
| | Magenta coupler MC-2 | 70 |
| | Yellow colored magenta coupler YMC-1 | 48 |
| | Universal coupler UC-1 | 238 |
| | Oxidized developer scavenger ODS-2 | 16 |
| | Development Accelerator DA-2 | 22 |
| | Tricresyl phosphate | 166 |
| | N,N-dibutyl lauramide | 44 |
| | Gelatin | 1277 |
| Inter-layer | Oxidized developer scavenger ODS-1 | 55 |
| | Tris(2-ethylhexl) phosphate | 82.5 |
| | Antifoggant AF-3 | 0.6 |
| | Gelatin | 860 |
| Slow blue sensitive layer | Blue sensitive emulsion A | 500 |
| | Blue sensitive emulsion B | 600 |
| | Yellow coupler YC-1 | 1045 |
| | Yellow modifying coupler YMC-1 | 70 |
| | Cyan modifying coupler CMC-2 | 9 |
| | Tricresyl phosphate | 557.5 |
| | N,N-Diethyl lauramide | 11.7 |
| | Polyacrylamide latex | 18 |
| | Gelatin | 1864 |
| Fast blue sensitive layer | Blue sensitive emulsion C | 875 |
| | Yellow coupler YC-1 | 240 |
| | Yellow modifying coupler YMC-1 | 50 |
| | Cyan modifying coupler CMC-2 | 11 |
| | Tricresyl phosphate | 145 |
| | N,N-Diethyl lauramide | 14.3 |
| | Gelatin | 1100 |

-continued

| Layer | Components | Amount (mg/m$^2$) |
|---|---|---|
| UV absorbing layer | Silver bromide Lippmann emulsion | 215 |
| | UV absorbing dye UV-1 | 105 |
| | UV absorbing dye UV-2 | 105 |
| | Tricresyl phosphate | 147 |
| | Manganese sulfate | 1.42 |
| | Gelatin | 690 |
| Overcoat | Polystyrene matte | 5.3 |
| | Polysiloxane lubricant | 39 |
| | Polyacrylate matte | 108 |
| | Gelatin | 867 |

Sample 4-2 was prepared identically to sample 4-1 except that in the Fast Green Sensitive Layer, Green Sensitive Emulsion D was replaced with Green Sensitive Emulsion E.

Sample 4-3 was prepared identically to sample 4-2 except that Green Sensitive Emulsion A was replaced with Green Sensitive Emulsion F and Green Sensitive Emulsion B was replaced with Green Sensitive Emulsion G in the Slow Green Sensitive Layer; and Green Sensitive Emulsion C was replaced with Green Sensitive Emulsion H in the Medium Green Sensitive Layer.

Additionally, spreading agents, 1,4,4a,7-tetraazaindene, and bis-vinylsulfonylmethane hardener were added to all of the samples.

The components of the film samples in Example 4 are firther identified here:

ODS-1

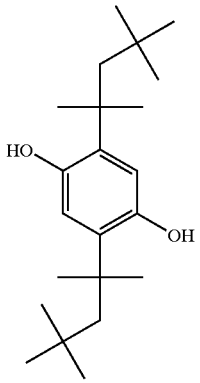

ODS-2

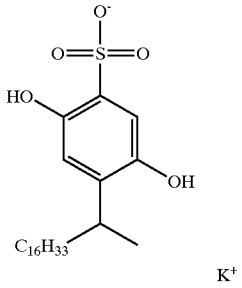

UV-1

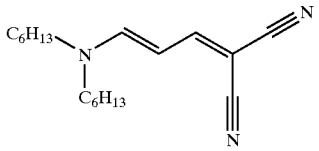

UV-2

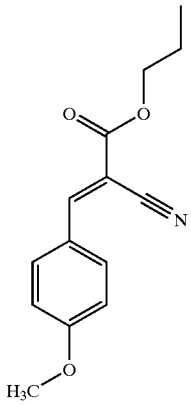

-continued
DA-1
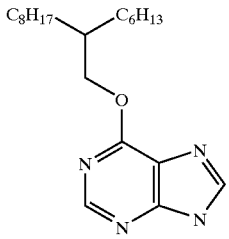
DA-2
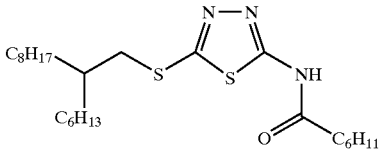
YD-1
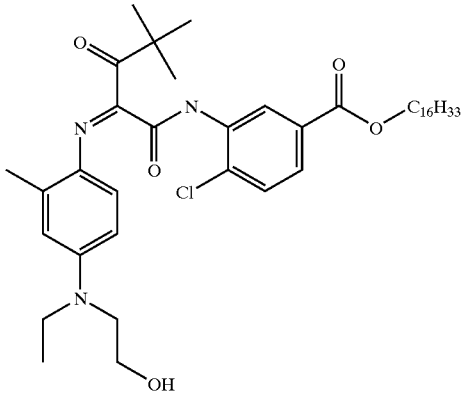
MD-1
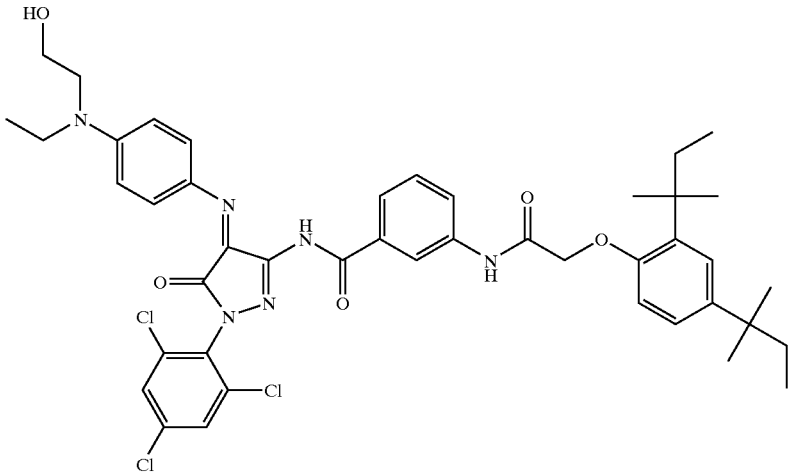
CD-1
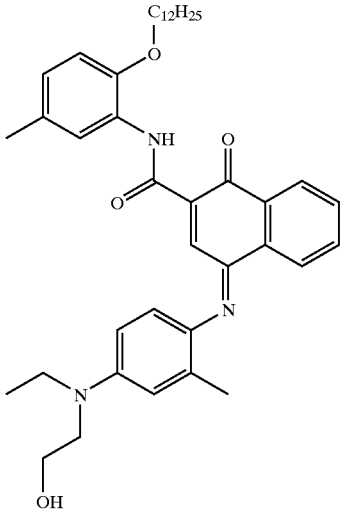
AF-1
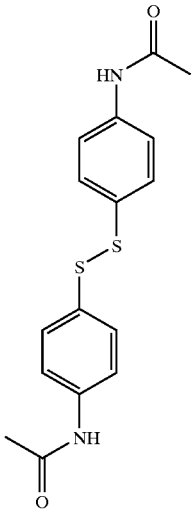

-continued
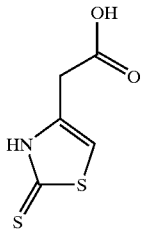
Metaphosphoric acid, hexasodium salt
AF-2
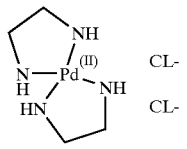
AF-3
SQ-1
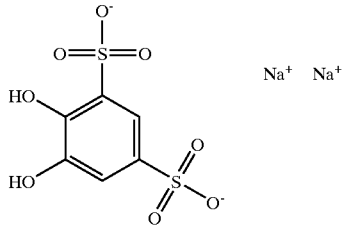
SQ-2
CC-1
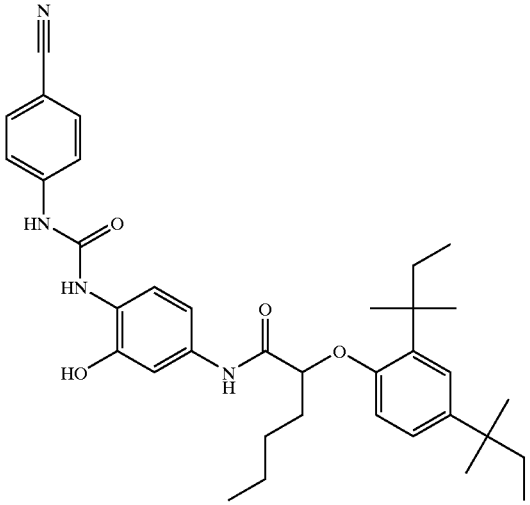
CC-2
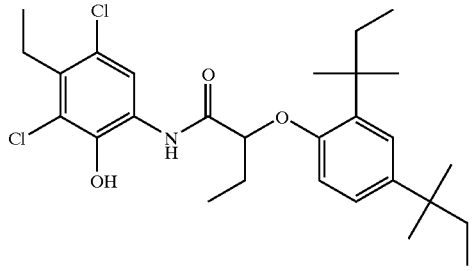
CMC-1
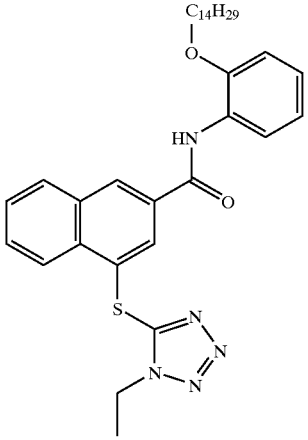
CMC-2
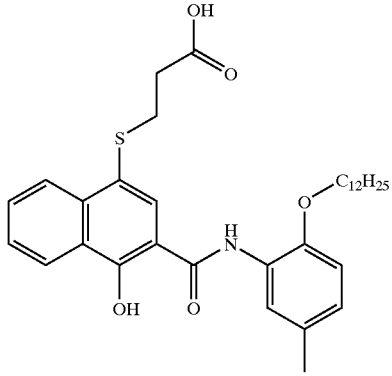

-continued
CMC-3
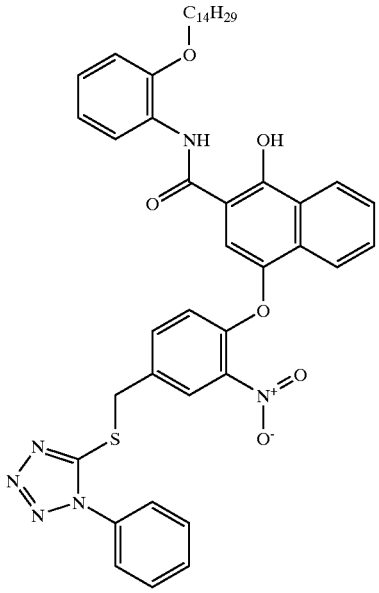
MCC-1
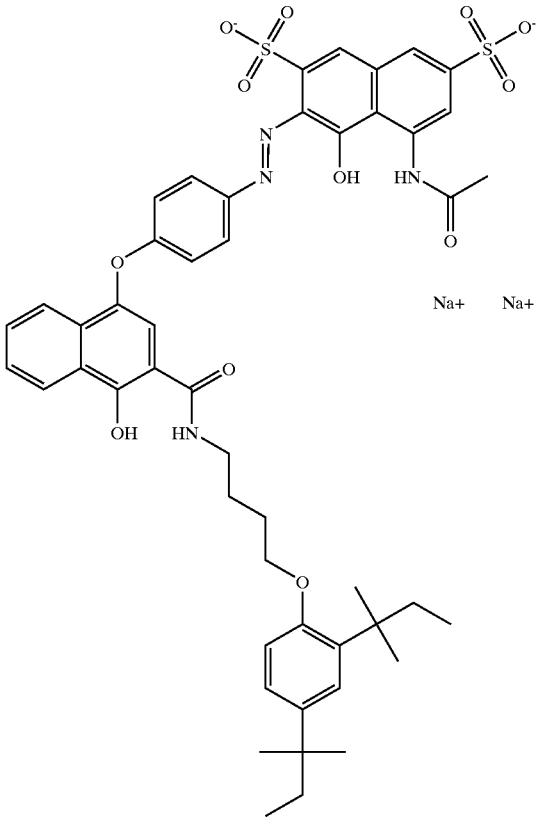
MC-1
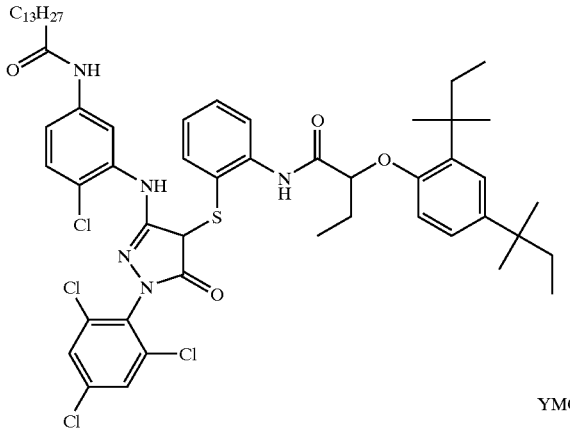
MC-2
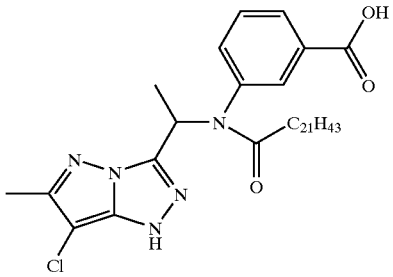
YMC-1
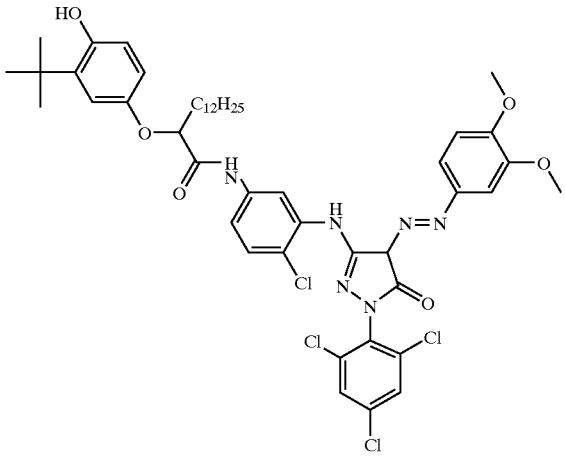
UC-1
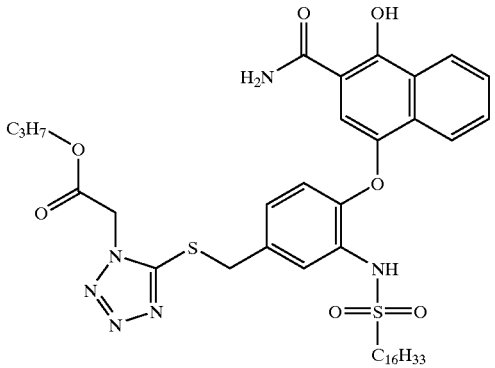

-continued

YC-1

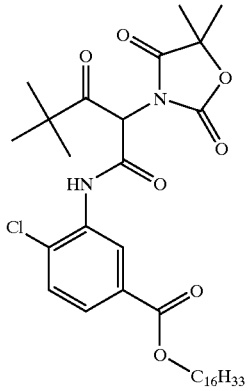

YMC-1

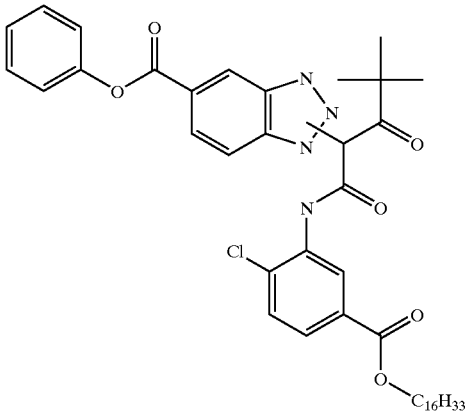

The following is a description of the emulsions used in Example 4. Tabular grain emulsion sizes refer to equivalent circular diameter measured by CPS Disc Centrifuge.

Red Sensitive Emulsion A: A silver iodobromide emulsion (1.38×0.13 micrometers) with 0% iodide run into the precipitation and 3.7% iodide added rapidly hear the end of the precipitation. Doped with 0.2 mg selenium and 0.012 mg iridium per mole of silver. Optimally sulfur/gold sensitized and spectrally sensitized with 0.775 mmoles of dye C and 0.129 mmoles of dye D per mole of silver.

Red Sensitive Emulsion B: A silver iodobromide emulsion (0.79×0.110 micrometers) with 0% iodide run into the precipitation and 4.5% iodide added rapidly near the end of the precipitation. Doped with 0.2 mg selenium and 0.003 mg iridium per mole of silver. Optimally sulfur/gold sensitized and spectrally sensitized with 0.810 mmoles of dye C and 0.134 mmoles of dye D per mole of silver.

Red Sensitive Emulsion C: A silver iodobromide emulsion (0.59×0.110 micrometers) with 1.5% iodide run into the precipitation and 1.5% iodide added rapidly near the end of the precipitation. Doped with 0.2 mg selenium and 0.2 mg iridium per mole of silver. Optimally sulfur/gold sensitized and spectrally sensitized with 0.887 mmoles of dye C and 0.148 mmoles of dye D per mole of silver.

Red Sensitive Emulsion D: A silver iodobromide emulsion (2.18×0.130 micrometers) with 0% iodide run into the precipitation and 3.7% iodide added rapidly near the end of the precipitation. Doped with 0.2 mg selenium and 25 micromole ruthenium per mole of silver. Optimally sulfur/gold sensitized and spectrally sensitized with 0.634 mmoles of dye C, 0.102 mmoles of dye D, and 0.038 mmoles of dye E per mole of silver.

Red Sensitive Emulsion E: A silver iodobromide emulsion (3.5×0.130 micrometers) with 0% iodide run into the precipitation and 3.7% iodide added rapidly near the end of the precipitation. Doped with 0.2 mg selenium and 25 micromole ruthenium per mole of silver. Optimally sulfur/gold sensitized and spectrally sensitized with 0.662 mmoles of dye C, 0.111 mmoles of dye D, and 0.041 mmoles of dye E per mole of silver.

Green Sensitive Emulsion A: A silver iodobromide emulsion (1.18×0.120 micrometers) with 0% iodide run into the precipitation and 4.5% iodide added rapidly near the end of the precipitation. Doped with 0.2 mg selenium and 0.024 mg iridium per mole of silver. Optimally sulfur/gold sensitized and spectrally sensitized with 0.838 mmoles of dye A and 0.209 mmoles of dye B per mole of silver.

Green Sensitive Emulsion B: A silver iodobromide emulsion (0.56×0.111 micrometers) with 1.5% iodide run into the precipitation and 1.5% iodide added rapidly near the end of the precipitation. Doped with 0.2 mg selenium and 0.2 mg iridium per mole of silver. Optimally sulfur/gold sensitized and spectrally sensitized with 0.960 mmoles of dye I-1 and 0.240 mmoles of dye I-5 per mole of silver.

Green Sensitive Emulsion C: A silver iodobromide emulsion (1.66×0.128 micrometers) with 0% iodide run into the precipitation and 4.5% iodide added rapidly near the end of the precipitation. Doped with 0.2 mg selenium and 0.003 mg iridium per mole of silver. Optimally sulfur/gold sensitized and spectrally sensitized with 0.713 mmoles of dye A and 0.189 mmoles of dye B per mole of silver.

Green Sensitive Emulsion D: A silver iodobromide emulsion (2.32×0.128 micrometers) with 2% iodide run into the precipitation and 4.5% iodide added rapidly near the end of the precipitation. Doped with 0.2 mg selenium and 25 micromoles ruthenium per mole of silver. Optimally sulfur/gold sensitized and spectrally sensitized with 0.677 mmoles of dye A and 0.205 mmoles of dye B per mole of silver in a first layer. Dye III-2 (1.2 mmoles/mole silver) was added as a second layer.

Green Sensitive Emulsion E: A silver iodobromide emulsion (2.32×0.127 micrometers) with 2% iodide run into the precipitation and 4.5% iodide added rapidly near the end of the precipitation. Doped with 0.2 mg selenium and 25 micromoles ruthenium per mole of silver. Optimally sulfur/gold sensitized and spectrally sensitized with 0.816 mmoles of dye I-1 and 0.204 mmoles of dye I-5 per mole of silver in a first layer. Dye III-2 (1.2 mmoles/mole silver) was added as a second layer.

Green Sensitive Emulsion F: A silver iodobromide emulsion (1.18×0.119 micrometers) with 0% iodide run into the precipitation and 4.5% iodide added rapidly near the end of the precipitation. Doped with 0.2 mg selenium and 0.024 mg iridium per mole of silver. Optimally sulfur/gold sensitized and spectrally sensitized with 0.968 mmoles of dye I-1 and 0.242 mmoles of dye I-5 per mole of silver.

Green Sensitive Emulsion G: A silver iodobromide emulsion (0.56×0.111 micrometers) with 1.5% iodide run into the precipitation and 1.5% iodide added rapidly near the end of the precipitation. Doped with 0.2 mg selenium and 0.2 mg iridium per mole of silver. Optimally sulfur/gold sensitized and spectrally sensitized with 0.960 mmoles of dye I-1 and 0.240 mmoles of dye I-5 per mole of silver.

Green Sensitive Emulsion H: A silver iodobromide emulsion (1.68×0.128 micrometers) with 0% iodide run into the precipitation and 4.5% iodide added rapidly near the end of the precipitation. Doped with 0.2 mg selenium and 0.003 mg iridium per mole of silver. Optimally sulfur/gold sensitized and spectrally sensitized with 0.832 mmoles of dye I-1 and 0.208 mmoles of dye I-5 per mole of silver.

Blue Sensitive Emulsion A: A silver iodobromide emulsion (1.98×0.135 micrometers) with 0% iodide run into the precipitation and 2.0% iodide added rapidly near the end of the precipitation. Doped with 0.2 mg selenium and 0.01 mg iridium per mole of silver. Optimally sulfur/gold sensitized and spectrally sensitized with 0.426 mmoles of dye F and 0.426 mmoles of dye G per mole of silver.

Blue Sensitive Emulsion B: A silver iodobromide emulsion (0.59×0.110 micrometers) with 1.5% iodide run into the precipitation and 1.5% iodide added rapidly near the end of the precipitation. Doped with 0.2 mg selenium and 0.2 mg iridium per mole of silver. Optimally sulfur/gold sensitized and spectrally sensitized with 0.488 mmoles of dye F and 0.489 mmoles of dye G per mole of silver.

Blue Sensitive Emulsion C: A saturated iodide core iodobromide octahedral emulsion with overall iodide concentration of 9.7%. Optimally sulfur/gold sensitized and spectrally sensitized with 0.224 mmoles of dye F.

Spectral sensitizing dyes used in Example 4:

Dye A

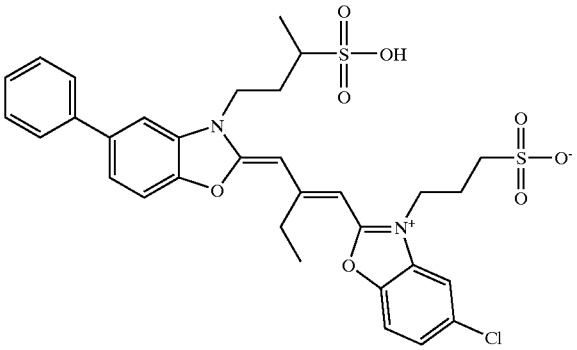

Dye B

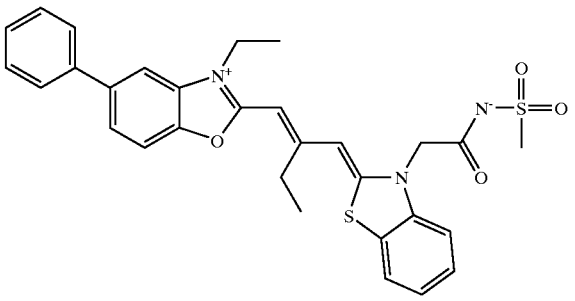

-continued

Dye C

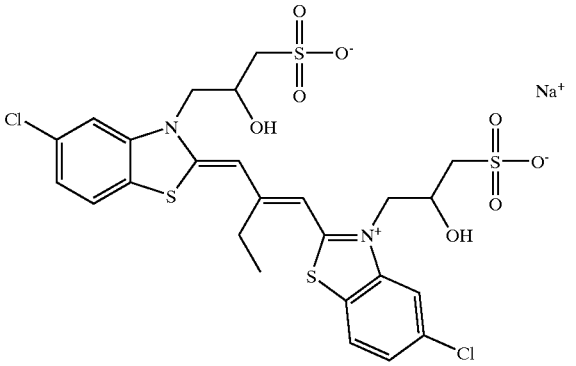

Dye D

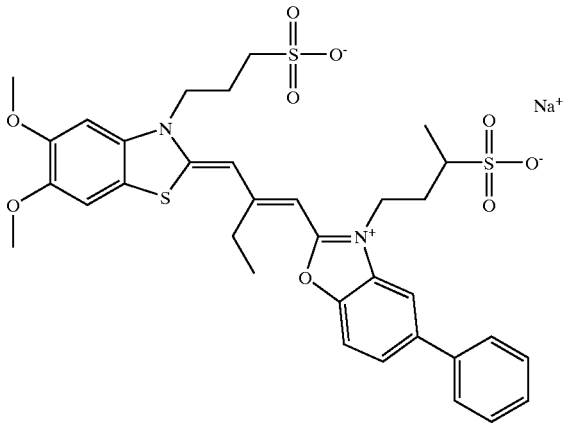

Dye E

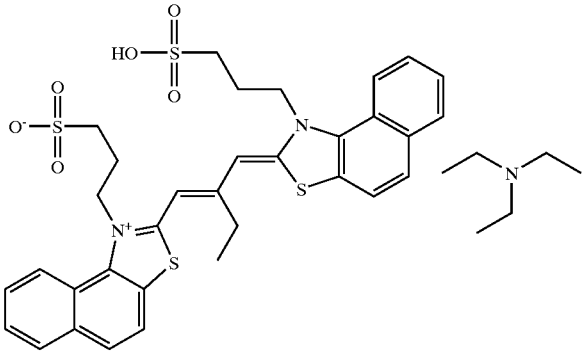

Dye F

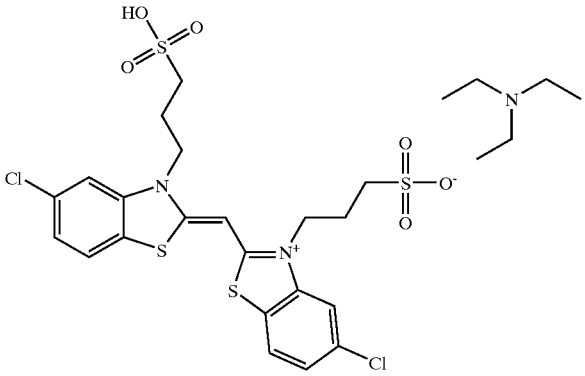

-continued

Dye G

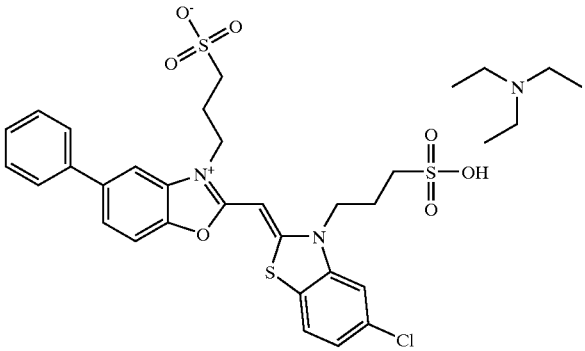

After coating and drying, the samples were cut into 35 mm film strips and tested for photographic efficiency and stain. Strips were given a 0.01 second daylight balanced exposure through a stepped wedge tablet. The strips were processed using the Kodak Flexicolor C-41 process as described in *Brit J. Photog. Annual*, 1988, p. 196–198 with the exception that the composition of the bleach solution was changed to comprise propylenediamine tetraacetic acid. The red, green, and blue status M density of each step was recorded, and the speed was calculated as 100 times the inverse exposure necessary to achieve a density of 0.15 above the minimum density.

The data from Example 4 that demonstrate the advantage of the invention are summarized in Table EX4-1.

TABLE EX 4-1

| Sample | Emulsion in Fast Green Sensitive Layer | Emulsion in Medium Green Sensitive Layer | Emulsions in Slow Green Sensitive Layer | Minimum Green Density (Green Speed) |
|---|---|---|---|---|
| 4-1 (Comparative) | Green Sensitive Emulsion D (Dye A, Dye B and Dye III-2) | Green Sensitive Emulsion C (Dye A and Dye B) | Green Sensitive Emulsions A and B (Dyes A and Dye B) | 0.609 (393) |
| 4-2 (Inventive) | Green Sensitive Emulsion E (Dye I-1, I-5, and III-2) | Green Sensitive Emulsion C (Dye A and Dye B) | Green Sensitive Emulsions A and B (Dyes A and Dye B) | 0.572 (392) |
| 4-3 (Inventive) | Green Sensitive Emulsion E (Dye I-1, I-5, and III-2) | Green Sensitive Emulsion H (Dyes I-1 and I-5) | Green Sensitive Emulsions F and G (Dyes I-1 and I-5) | 0.538 (394) |

Another set of unexposed film strips from samples 4-1, 4-2, and 4-3 were submitted to a modified process in that the strips were processed through the fixer first, followed by the normal develop, bleach, fix, and wash steps. This process removes the silver halide first, so that the only density in the film is from incorporated colored components and retained sensitizing dye. There is no contribution from image dye formed as a result of the development of fog centers. The spectral density of the strips was then obtained by scanning transmission spectroscopy. The density at 510 nm and at 555 nm was recorded. The results are given in Table EX4-2.

TABLE EX 4-2

| Sample | Emulsion in Fast Green Sensitive Layer | Emulsion in Medium Green Sensitive Layer | Emulsions in Slow Green Sensitive Layer | Spectral density at 510 nm, 555 nm |
|---|---|---|---|---|
| 4-1 (Comparative) | Green Sensitive Emulsion D (Dye A, Dye B and Dye III-2) | Green Sensitive Emulsion C (Dye A and Dye B) | Green Sensitive Emulsions A and B (Dyes A and Dye B) | 0.640, 0.460 |
| 4-2 (Inventive) | Green Sensitive Emulsion E (Dye I-1, I-5, and III-2) | Green Sensitive Emulsion C (Dye A and Dye B) | Green Sensitive Emulsions A and B (Dyes A and Dye B) | 0.618, 0.431 |
| 4-3 (Inventive) | Green Sensitive Emulsion E (Dye I-1, I-5, and III-2) | Green Sensitive Emulsion H (Dyes I-1 and I-5) | Green Sensitive Emulsions F and G (Dyes I-1 and I-5) | 0.541, 0.422 |

These data show that the dye combination of the invention reduces the overall green density, but, moreover, the unwanted density at 510 nm that causes a problem for printing is greatly reduced.

The invention has been described in detail with particular reference to certain preferred embodiments thereof, but it will be understood that variations and modifications can be effected within the spirit and scope of the invention.

What is claimed is:

1. A silver halide photographic element comprising at least one silver halide emulsion comprising silver halide grains which have associated therewith at least an inner dye layer and an outer dye layer wherein the outer dye layer comprises a dye having at least one substituent that has a positive charge, said photographic element further comprising a cyanine dye of formula (I) or (II) that is capable of spectrally sensitizing a silver halide emulsion:

(I)

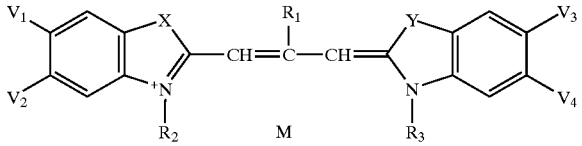

wherein:

X is O or $NR_4$;

Y is O, S, or $NR_4$;

$R_1$ is H or a 1–4 carbon alkyl group;

$R_2$ and $R_3$ are independently 1–6 carbon alkyl group comprising an acid salt substituent;

$R_4$ is a 1–4 carbon alkyl group;

$V_1$ to $V_4$ are hydrogen or substituents with a pi constant of less than 1.0;

M is a counterion to balance the charge if necessary;

(II)

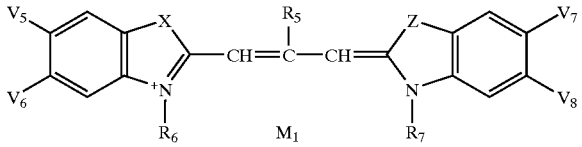

wherein:

W is O, S, Se, or $NR_4$;

Z is S or Se;

$R_5$ is H, or a 1–4 carbon alkyl group;

$R_6$ and $R_7$ are independently 1–6 carbon alkyl groups comprising an acid salt substituent;

$R_4$ is a 1–4 carbon alkyl group;

$V_5$ to $V_8$ are hydrogen or substituents with a pi constant of less than 0.75 provided that at least three of $V_5$ to $V_8$ are hydrogen or substituents with a pi constant of 0.65 or less;

$M_1$ is a counterion to balance the charge if necessary.

2. The silver halide photographic element of claim 1, wherein the dye of formula (I) is further represented by formula (Ib), (Ib)

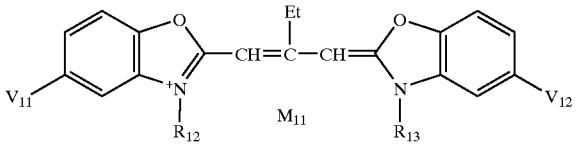

wherein:

$R_{12}$ and $R_{13}$ are independently 1 to 6 carbon alkyl groups comprising an acid salt substituent;

$V_{11}$ and $V_{12}$ are independently a halogen;

$M_{11}$ is a counterion to balance the charge if necessary.

3. The silver halide photographic element of claim 1, wherein the dye of formula II is further represented by formula (IIb), (IIb)

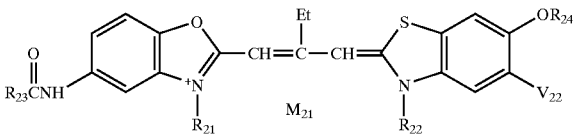

wherein:

$R_{21}$ and $R_{22}$ are independently 1–6 carbon alkyl groups substituted with an acid salt substituent;

$R_{23}$ and $R_{24}$ are independently substituted or unsubstituted 1–6 carbon alkyl groups;

$V_{22}$ is a halogen;

$M_{21}$ is a counterion to balance the charge.

4. The silver halide photographic element of claim 1 wherein the dye layered silver halide emulsion is a green sensitive silver halide emulsion and the inner dye layer comprises at least one dye represented by structure (I).

5. The silver halide photographic element of claim 1 wherein the dye layered silver halide emulsion is a red sensitive silver halide emulsion and the inner dye layer comprises at least one dye represented by structure (II).

6. The silver halide photographic element of claim 1 wherein the dye layered silver halide emulsion is a green sensitive silver halide emulsion, said photographic element further comprising one or more additional green sensitive silver halide emulsions at least one of which is sensitized with at least one dye described by structure (I).

7. The silver halide photographic element of claim 1 wherein the dye layered silver halide emulsion is a red sensitive silver halide emulsion, said photographic element further comprising one or more additional red sensitive silver halide emulsions, at least one of which is sensitized with at least one dye described by structure (II).

8. The silver halide photographic element of claim 6 wherein at least 50% by surface area of the one or more additional green sensitive emulsions are sensitized with at least one dye described by structure (I).

9. The silver halide photographic element of claim 7 wherein at least 50% by surface area of the one or more additional red sensitive emulsions are sensitized with at least one dye described by structure (II).

10. The silver halide photographic element of claim 1 wherein the dye having at least one substituent that has a positive charge is a cyanine dye.

11. The silver halide photographic element of claim 1 wherein the dye having at least one substituent that has a positive charge is a dye other than a cyanine dye.

12. The silver halide photographic element of claim 1 wherein the dye having at least one substituent that has a positive charge is a merocyanine dye, an oxonol, dye, an arylidene dye, a complex merocyanine dye, a styryl dye, a hemioxonol dye, an anthraquinone dye, a triphenylmethane dye, an azo dye type, a azomethine dye, or a coumarin dye.

13. The silver halide photographic element of claim 12 wherein the dye having at least one substituent that has a positive charge is a merocyanine dye.

14. The silver halide photographic element of claim 1 wherein the dye having at least one substituent that has a positive charge is represented by formula (III), (III)

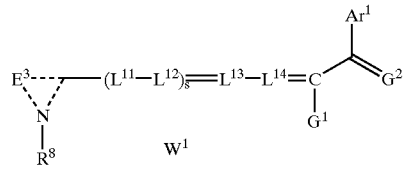

wherein:

$R^8$ is an alkyl or aryl group comprising at least one cationic substituent;

$E^3$ represents the atoms necessary to complete a substituted or unsubstituted 5- or 6-membered heterocyclic nucleus;

$Ar^1$ is a substituted or unsubstituted alkyl or aryl group;

$L^{11}$ through $L^{14}$ are substituted or unsubstituted methine groups;

s is 0 or 1;

$G^1$ is an electron-withdrawing group;

$G^2$ is O or dicyanovinyl ($C(CN)_2$); and $W^1$ is a counterion if necessary.

15. The silver halide photographic element of claim 1 wherein the dye having at least one substituent that has a positive charge is described by formula (IIIb)

(IIIb)

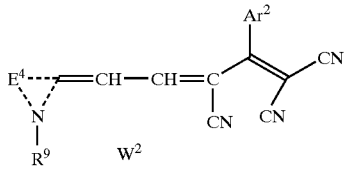

wherein:

$R^9$ is an alkyl or aryl group that comprises at least one cationic substituent;

$E^4$ represents the atoms necessary to complete a substituted or unsubstituted benzoxazole, benzothiazole, or quinoline nucleus;

$Ar^2$ is a substituted or unsubstituted aryl group; and $W^2$ is a counterion if necessary.

16. The silver halide photographic element of claim 2 wherein the dye having at least one substituent that has a positive charge is described by formula (IIIb)

(IIIb)

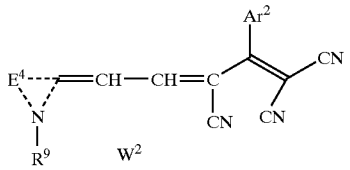

wherein:

$R^9$ is an alkyl or aryl group that comprises at least one cationic substituent;

$E^4$ represents the atoms necessary to complete a substituted or unsubstituted benzoxazole, or quinoline nucleus;

$Ar^2$ is a substituted or unsubstituted aryl group; and $W^2$ is a counterion if necessary.

17. The silver halide photographic element of claim 3 wherein the dye having at least one substituent that has a positive charge is described by formula (IIIb), (IIIb)

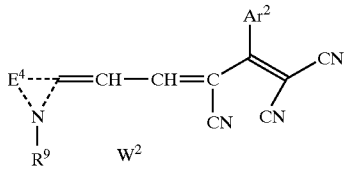

wherein:

$R^9$ is an alkyl or aryl group that comprises at least one cationic substituent;

$E^4$ represents the atoms necessary to complete a substituted or unsubstituted benzoxazole, or quinoline nucleus;

$Ar^2$ is a substituted or unsubstituted aryl group; and $W^2$ is a counterion if necessary.

18. The silver halide photographic element of claim 1 wherein the dye having at least one substituent that has a positive charge is represented by formula (IIIc), (IIIc)

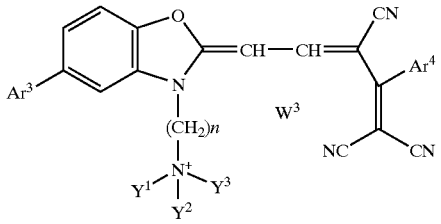

wherein:

$Y^1$, $Y^2$, and $Y^3$ independently represents substituted or unsubstituted alkyl groups;

$Ar^3$ and $A^4$ independently represents substituted or unsubstituted aromatic groups;

n represents an integer from 3 to 5; and $W^3$ is a counterion if necessary.

19. The silver halide photographic element of claim 18 wherein $Y^1$, $Y^2$, and $Y^3$ of formula (Illc) independently represents hydroxyethyl or methyl groups; $Ar^3$ and $Ar^4$ independently represents substituted or unsubstituted phenyl groups; and n is 3 or 4.

20. The silver halide photographic element of claim 1 wherein the dye having at least one substituent that has a positive charge is represented by formula (IIId), (IIId)

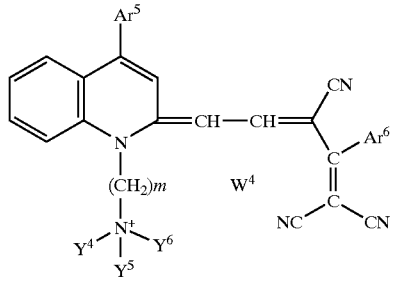

wherein:

$Y^4$, $Y^5$, and $Y^6$ independently represents substituted or unsubstituted alkyl groups;

$Ar^5$ represents a substituted or unsubstituted phenyl group and the quinoline nucleus of formula Ild may be further substituted;

$Ar^6$ represents a substituted or unsubstituted aromatic group;

m represents an integer from 3 to 5; and $W^4$ is a counterion if necessary.

* * * * *

UNITED STATES PATENT AND TRADEMARK OFFICE

CERTIFICATE OF CORRECTION

PATENT NO. : 6,787,297 B1
DATED : September 7, 2005
INVENTOR(S) : Steven G. Link et al.

It is certified that error appears in the above-identified patent and that said Letters Patent is hereby corrected as shown below:

Column 58,
Lines 60-65, please delete the following structure:

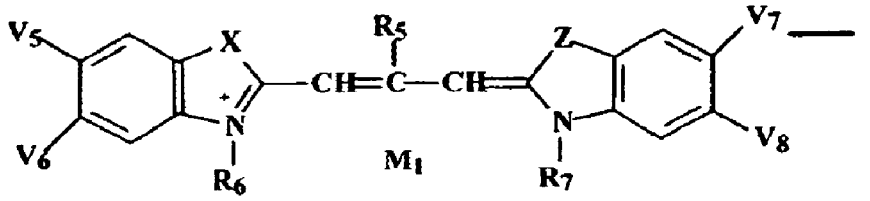

and in place thereof insert the following structure:

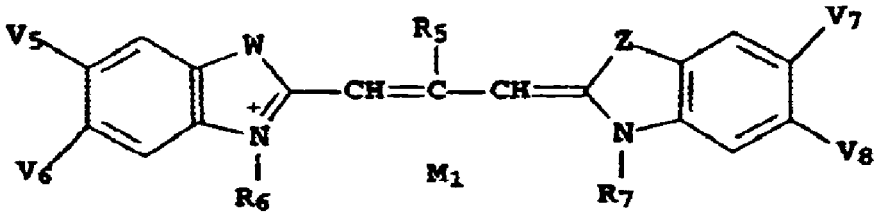

Column 62,
Line 52, please delete "Ild" and insert in place thereof -- IIId --.

Signed and Sealed this

Twenty-second Day of November, 2005

JON W. DUDAS
*Director of the United States Patent and Trademark Office*